US005906566A

United States Patent [19]

Whitcomb

[11] Patent Number: 5,906,566

[45] Date of Patent: May 25, 1999

[54] EXERCISE MACHINE

[76] Inventor: Tracy L. Whitcomb, 160 E. 175th Terrace Dr., Redington Shores, Fla. 33708

[21] Appl. No.: 08/800,876

[22] Filed: Feb. 14, 1997

Related U.S. Application Data

[63] Continuation-in-part of application No. 08/676,956, Jul. 8, 1996.

[51] Int. Cl.[6] ..... A63B 21/02

[52] U.S. Cl. ..... 482/130; 482/138; 482/133; 482/137

[58] Field of Search ..... 422/133, 135, 422/136, 137, 138, 130

[56] References Cited

U.S. PATENT DOCUMENTS 5,069,447 12/1991 Snyderman et al. ..... 482/137

5,352,171 10/1994 Lin ..... 482/137

5,549,530 8/1996 Fulks ..... 482/138

*Primary Examiner*—Lynne A. Reichard

*Attorney, Agent, or Firm*—Lyon & Lyon LLP

[57] ABSTRACT

An exercise machine having a support base to which three support beams are pivotally mounted. The outside support beams are extendible. The center beam is pivotally mounted to a seat and a seat back. The outside beams are mounted to the seat and the seat back, respectively. A leg pivotally depends from the seat, A fork element with pivotally mounted arms at the distal ends thereof is pivotally mounted to the base. Three resistance bands are positioned on the pivotally mounted arms. The assembly is capable of relative pivotal motion between components to collapse the assembly for storage and portability. Expanded, the seat, the seat back, the depending leg and the fork structure with the arms are capable of pivotal motion relative to one another to position the various components for different modes of exercise.

15 Claims, 26 Drawing Sheets

D
C
G
83
82
F
A
E
82
83
59
50
B
34
41
84
85

EXERCISE MACHINE

CROSS REFERENCE TO RELATED APPLICATIONS

This is a continuation-in-part of U.S. patent application Ser. No. 08/676,956, filed Jul. 8, 1996 now pending.

BACKGROUND OF THE INVENTION

The field of the present invention is exercising machines. There was no exercise machine available that could both perform a wide variety of exercises, in a quick and simple manner, and then be folded compact for easy storage and portability.

SUMMARY OF THE INVENTION

The present invention is directed to a multifunction exercise machine which can be folded into a compact configuration for easy storage and portability.

In a first, separate aspect of the present invention, an exercise machine includes a support base, a seat, a seat back, a leg pivotally depending at one end of the seat, arms, resistance elements attached to the arms and an articulated support linkage. The articular support linkage includes a storage position with the components compactly arranged.

In a second, separate aspect of the present invention, the substantive components of the first aspect further include the articulated support linkage including one or more exercise positions in addition to the storage position. Included collectively or in the alternative are the sit-up, leg curl, leg extension, bent over row, seated arm curl, tricep extension, lat pull down and/or butterfly exercise positions.

In a third, separate aspect of the present invention, the subject matter of any of the foregoing separate aspects may be combined to provide an improved exercise system.

Accordingly, it is an object of the present invention to provide an improved exercise system. Other and further objects and advantages will appear hereinafter.

BRIEF DESCRIPTION OF THE DRAWINGS

With the drawing accompanying this outline, a better reference may be made to show the details of the exercise machine.

DESCRIPTION OF EMBODIMENTS

Figure 1:
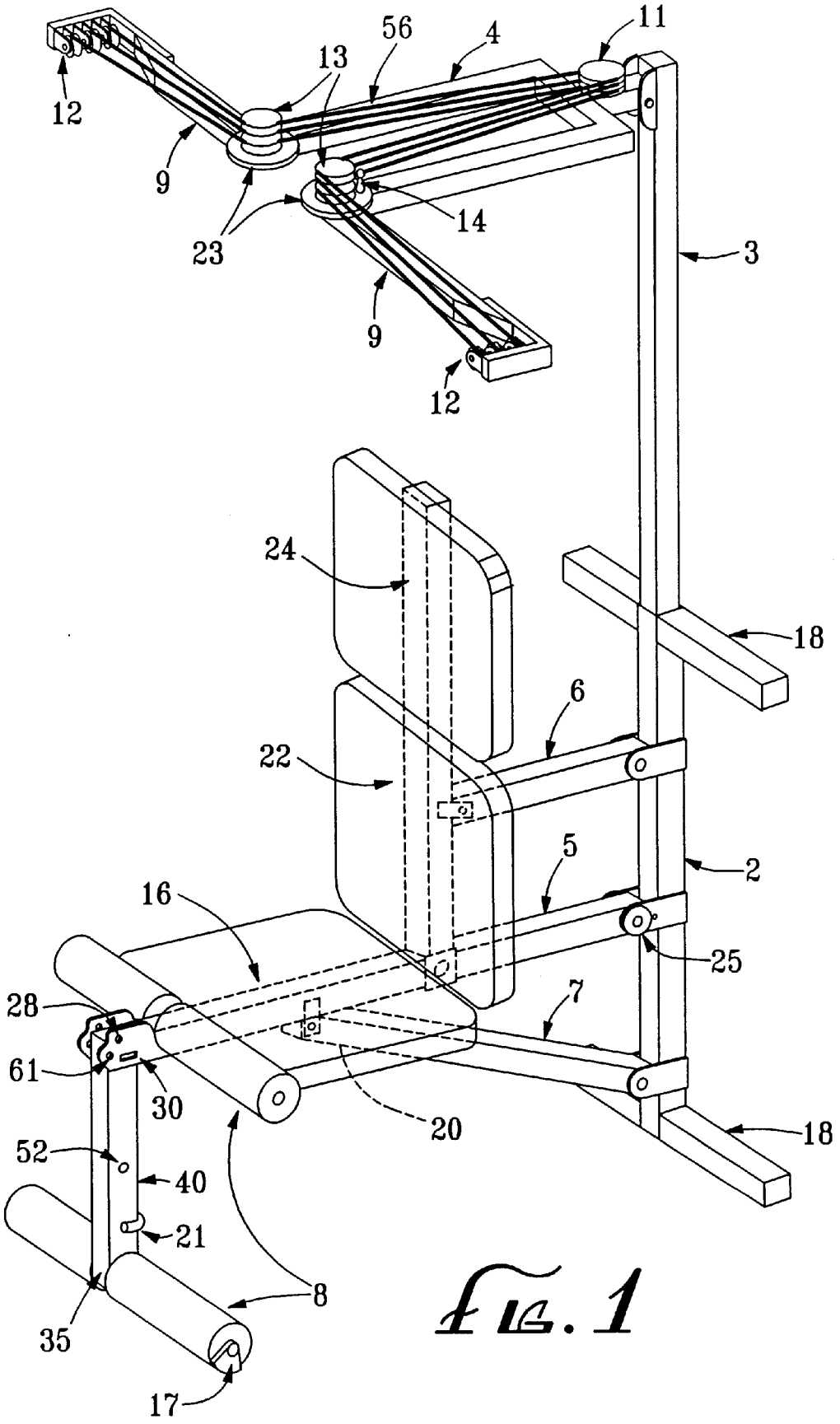
FIG. 1 is a perspective view of the exercise machine in an upright position which is an operative state.

The exercise machine illustrated in FIGS. 1 through 4 has a support base 2, a pair of support legs 18, three pivotable support beams 5,6,7, a padded seat 16, two padded backs 22,24, two telescopic support beams 20,31, a telescopic arm 3, a pivotal fork 4, a pair of pivotal arms 9, a two piece pivotal leg 35, 40, two pairs of padded rollers 8, four sets of three pulleys 12, 13, and three resistance bands 56.

Figure 2:
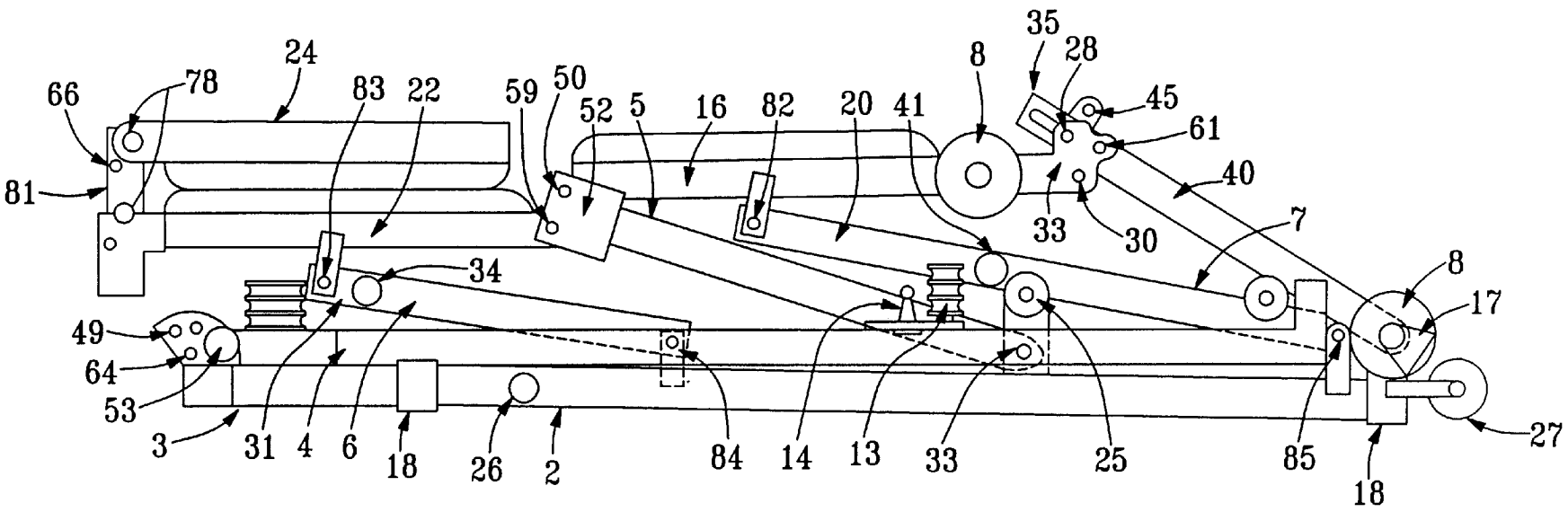
FIG. 2 is a side view of the exercise machine in a compact inoperative state.
Figure 3:
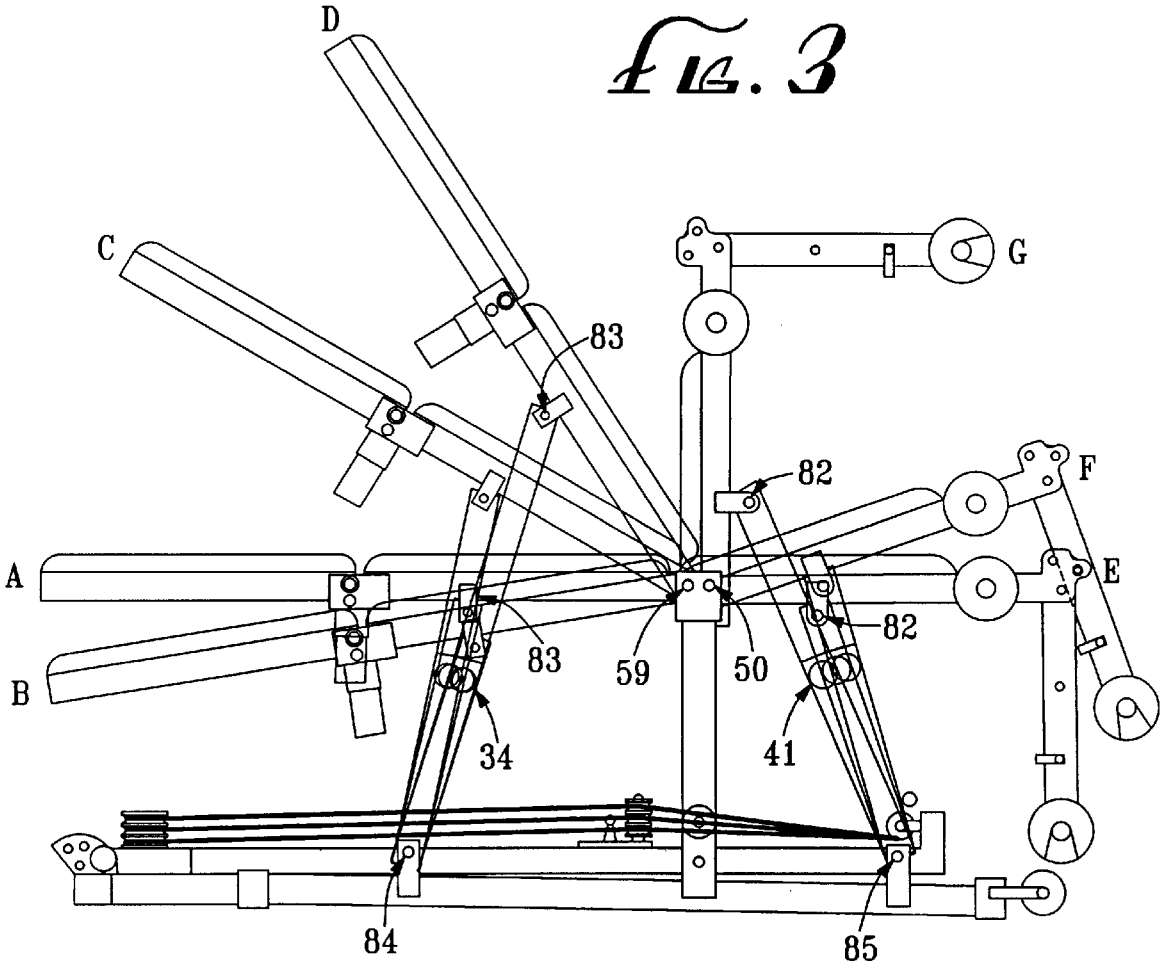
FIG. 3 is a side view of the exercise machine in which the padded seat and back of the exercise machine is shown adjusted to different angles in an operative state.
Figure 4:
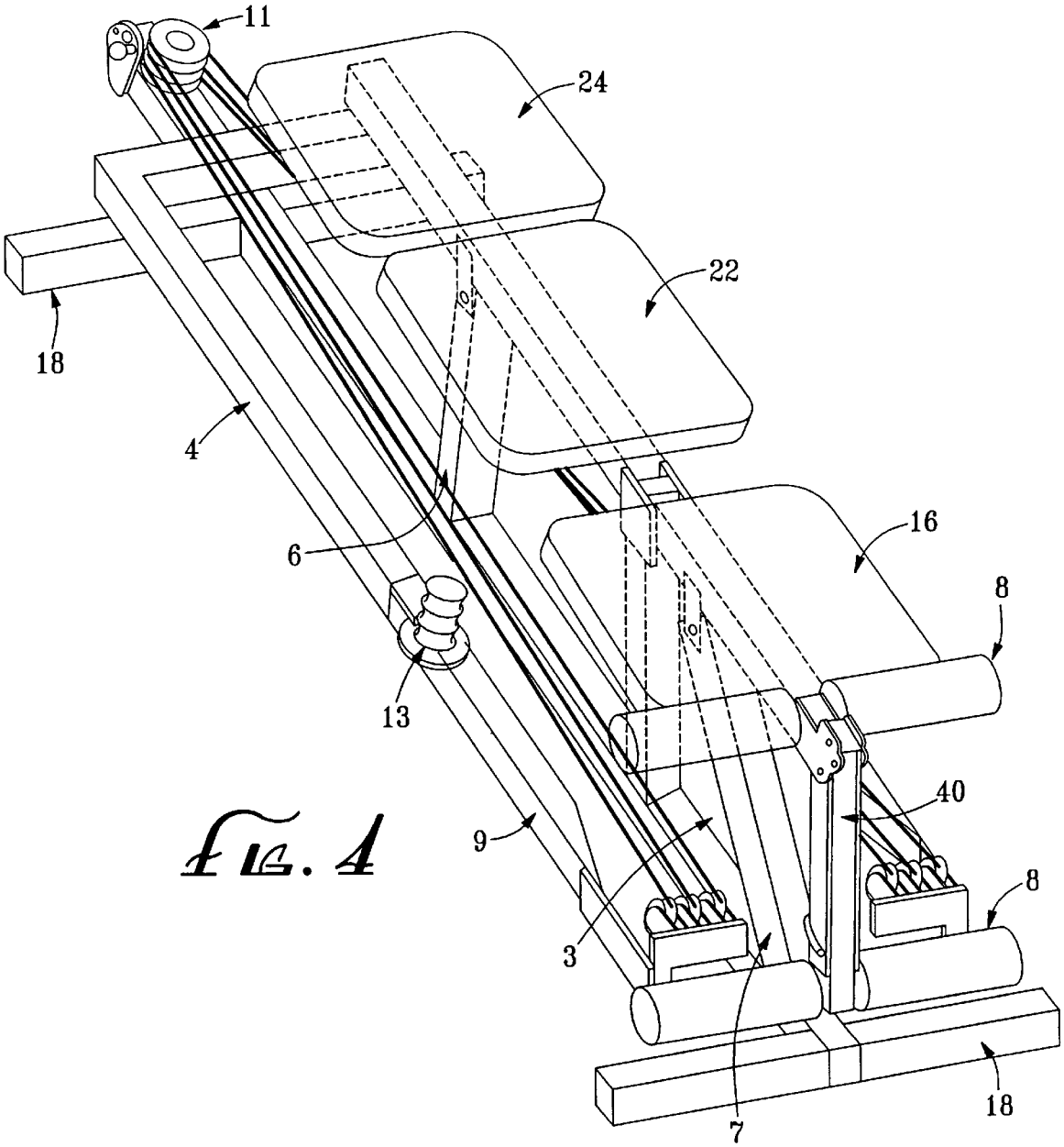
FIG. 4 is a perspective view of the exercise machine in its first ready position, in an operative state.
Figure 6:
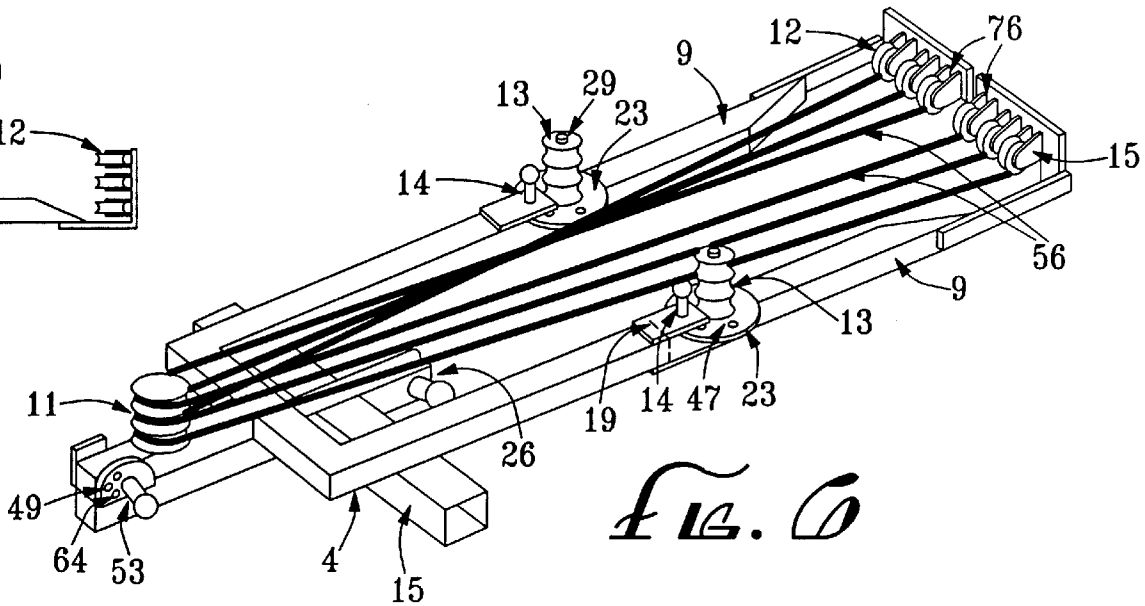
FIG. 6 is a perspective view of the versatile pivotable arms and resistance bands of the exercise machine.
Figure 7:
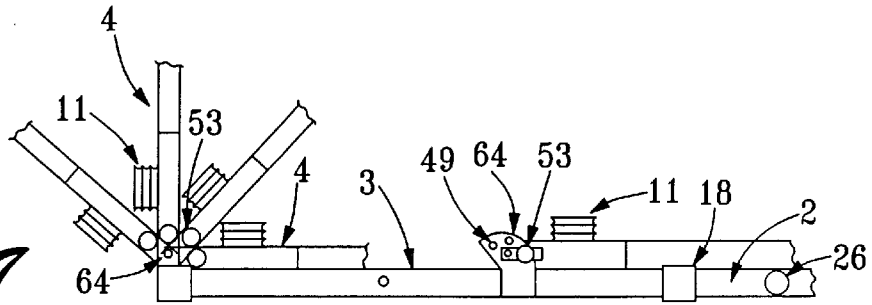
FIG. 7 is a side view of the telescopic arm and the different pivotal settings of the pivotal fork and arms.
Figure 5:
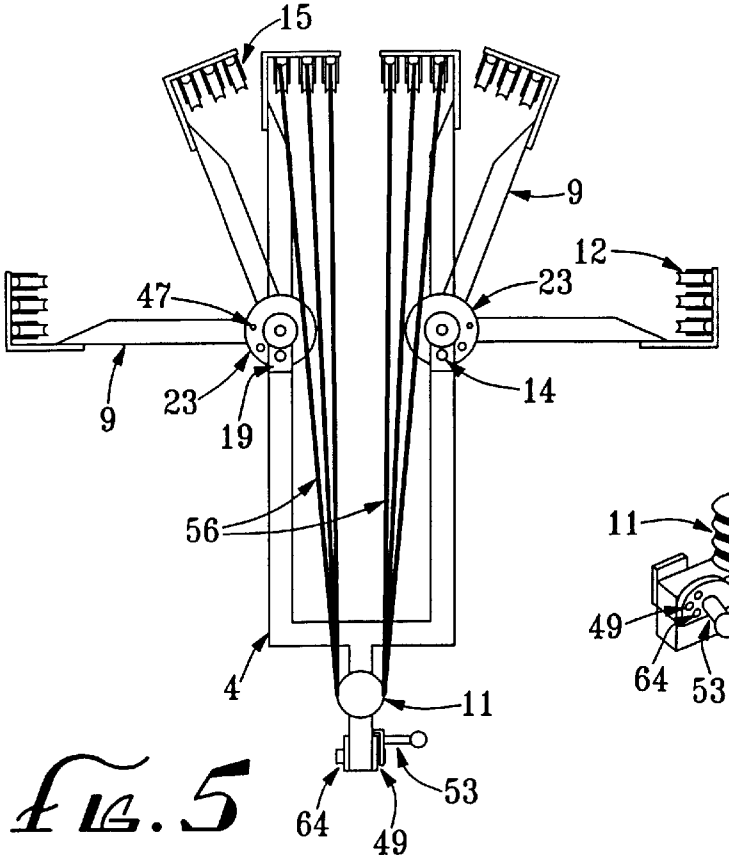
FIG. 5 is a plan view of the versatile pivotable arms of the exercise machine.
Figure 9:
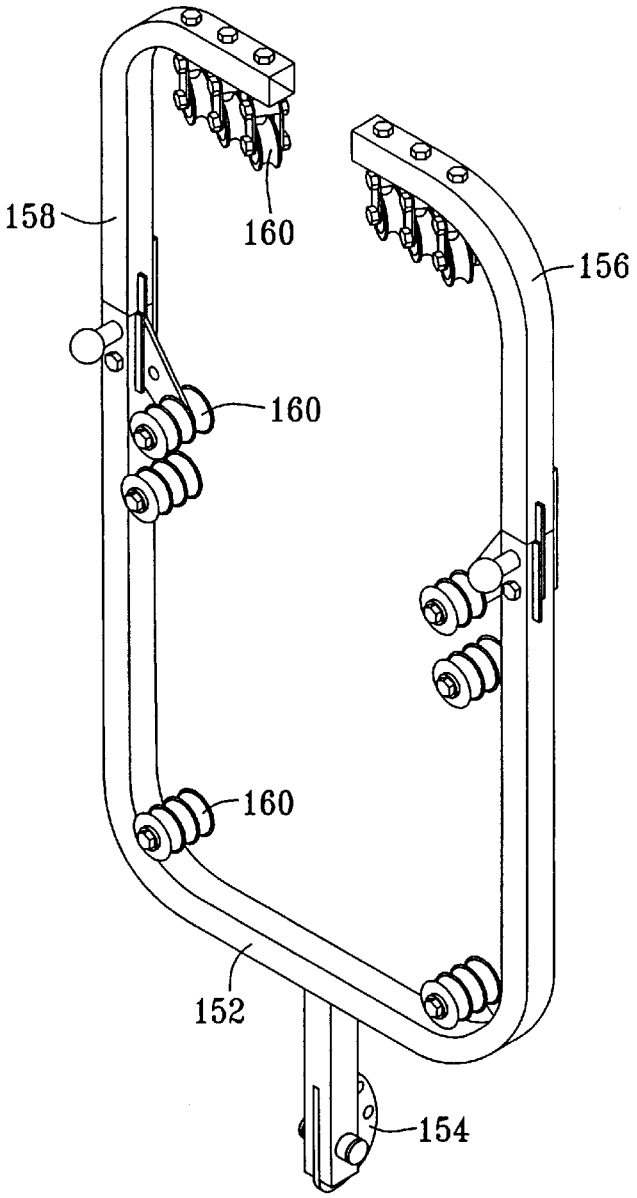
FIG. 9 is an assembled perspective of the arm support and the arms.
Figures 10, 10A, 10B:
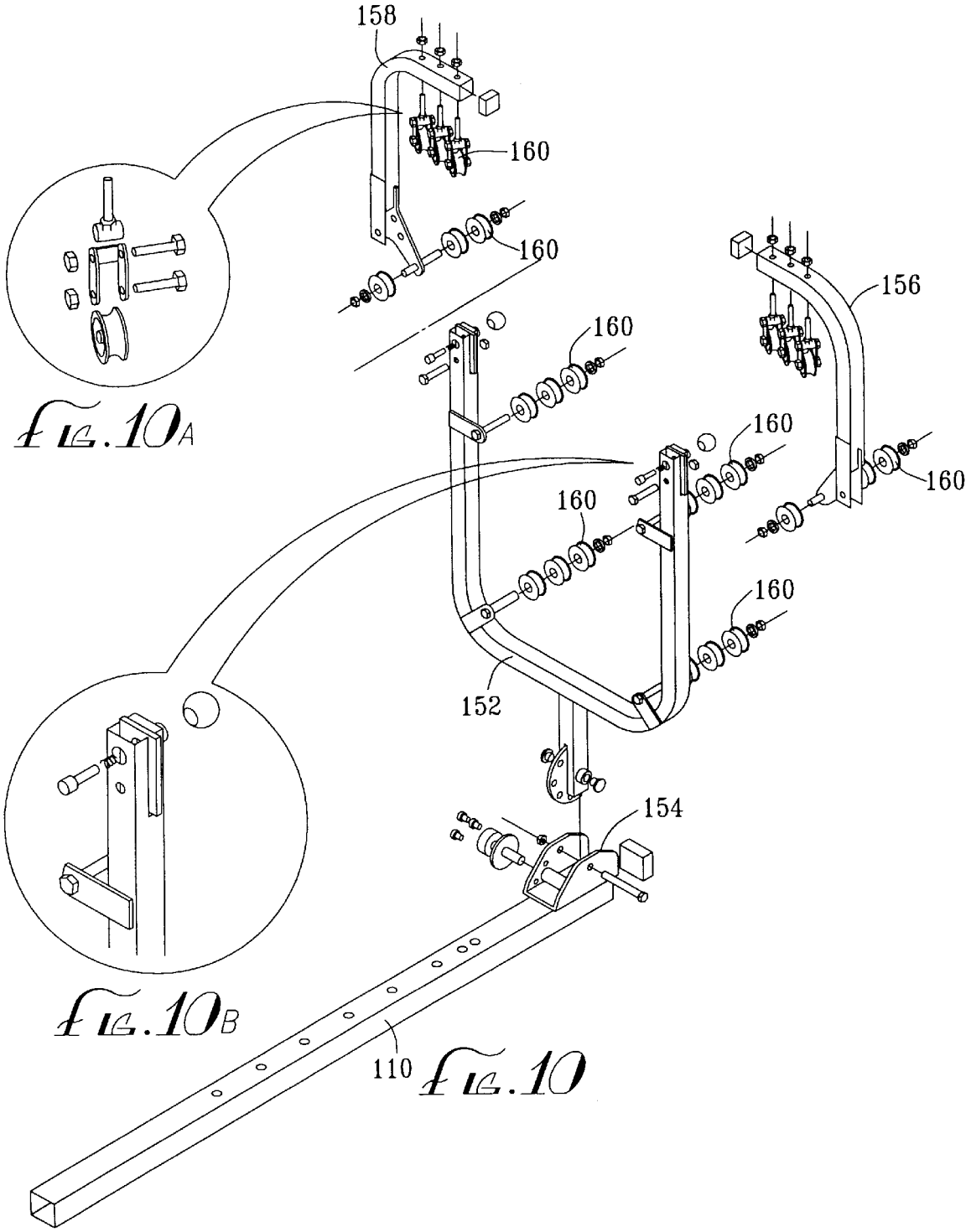
FIG. 10 is an exploded perspective view of the mechanism of FIG. 9.

The support legs 18 are permanently connected to the support base 2. The support base is tubular to allow the telescopic arm 3 to insert inside, as shown in FIG. 7. The telescopic arm 3 is able to slide in and out of the support base 2 and can be locked into place by a snap pin 26, which is permanently connected to the right side of the support base, as shown in FIGS. 6 and 7. This telescopic arm can be adjusted to fixed lengths for use in a variety of different exercises. There is a stay 49 with a snap pin 53 permanently connected to the top end of the telescopic arm (FIGS. 6,7). A pivotal fork 4 is then pivotally connected to the telescopic arm 3 by the stay 49 permanently attached to the rear of the telescopic arm. The snap pin 53 on the say 49 allows the pivotal fork to be locked in four different angles, as shown in FIG. 7. Each angle may be used for a different exercise, the two pivotal arms are pivotally connected to the stays 23 on the ends of each fork arm, as shown in FIGS. 5 and 6. A snap pin 14 is also permanently attached to the stay 23 on the end of each of the fork arms of the pivotal fork 4 (FIG. 6). The snap pin 14 allows the pivotal arm 9 to be adjusted and locked to different angles, as shown in FIG. 5. A set of pulleys 13 are attached to each pivotal fork stay 23 by a pin 29 that also allows the pivotal arm 9 to pivot, as shown in FIG. 6. Another set of three pulleys 12 is connected to stays 15 at the end of each pivotal arm 9 (FIGS. 5, 6). An oversized pulley 11 is permanently connected to the pivotal fork base, as shown in FIGS. 5, 6, and 7. There are three sets of resistance bands 56 that thread through the pulleys 12 at the end of the pivotal arm 9. The bands 56 then run down the pivotal arm 9 and the arm support, or fork 4, around the oversized pulley 11 and return down the other fork arm and pivotal arm 9 and thread through the pulleys 12 at the end of the pivotal arm, as shown in FIG. 6. A rubber stopper near the ends of the resistance bands keep the bands from pulling back through the pulleys. At the very ends of each resistance band are eye hooks 76, as shown in FIG. 6. These eye hooks 76 allow a handle/ankle strap to clip on so a user can use one, two or all three resistance bands during exercise. The pulleys allow the smooth flow of the resistance bands while any given exercise is being performed. The padded seat 16 and back 22 are pivotally connected to the support base 2 by three pivotal support beams 5, 6, and 7, as illustrated in FIG. 2. The support base 2 has three sets of stays 33, 84, and 85 permanently connected at given areas. A pin through the pivotal support beams and stays connect them in a pivotal manner. The main (middle) support beam 5 may be locked vertically or unlocked to fold horizontally by screwing or unscrewing a jam nut 25. When locked vertically the exercise machine is in an operative state, as shown in FIGS. 3 and 4. When the jam nut 25 is unlocked, the main support beam 5, along with the two outer support beams 6, 7, can be pivotally folded flat or nearly flat on top of the support base 2. In this position the exercise machine is in an inoperative state, as shown in FIG. 2. The top of the main pivotal support beam 5 has a pair of braces 52. The padded seat beam 16 and main padded back beam 22 are pivotally connected to main pivotal support beam 5 by pins through holes 50 and 59, as shown in FIG. 2. The two outer pivotal support beams (6 and 7) are tubular to allow the insertion of telescopic beams 20 and 31. The front telescopic beam 20 is pivotally connected to the stay 82 on the padded seat beam 16. The rear telescopic beam is pivotally connected to the stay 83 on the main padded back beam 22, as shown in FIG. 2. The two outer support beams 6 and 7, both have a snap pin attached at the top, as shown in FIG. 3. The snap pin 34 on the rear support beam allows the inserted telescopic beam 31 to adjust the padded back to any of the four given angles, as shown in FIG. 3. The snap pin 41 on the front support beam 16 allows the inserted telescopic beam to adjust the padded seat to any of the three given angles, also shown in FIG. 3. The padded seat comes in two pieces, which allows the padded back to be folded in half. This allows the exercise machine to be compact and portable, as shown in FIG. 2. The padded back therefore has an operative and inoperative state. In an inoperative state, the second half of padded back 24 is folded on top of the main padded back 22 and locked into place by a jam nut 78, as shown in FIG. 9. The padded back can be put into an operative state by: (1) unscrewing the jam nut 78; (2) pivoting the second half of padded back 24 180°; (3) one must then remove the pin from hole 57, thus allowing the small telescopic arm 81 to drop into the notched housing 44 attached to the rear of the main padded back 22. The second half of padded back 24 is now in a linear plane with the main padded back 22; (4) the pin is then replaced through both hole 66 and 10 in the notched housing 44; (5)

the jam nut 78 is then locked down to secure the padded back in an operative state.

Figure 8:
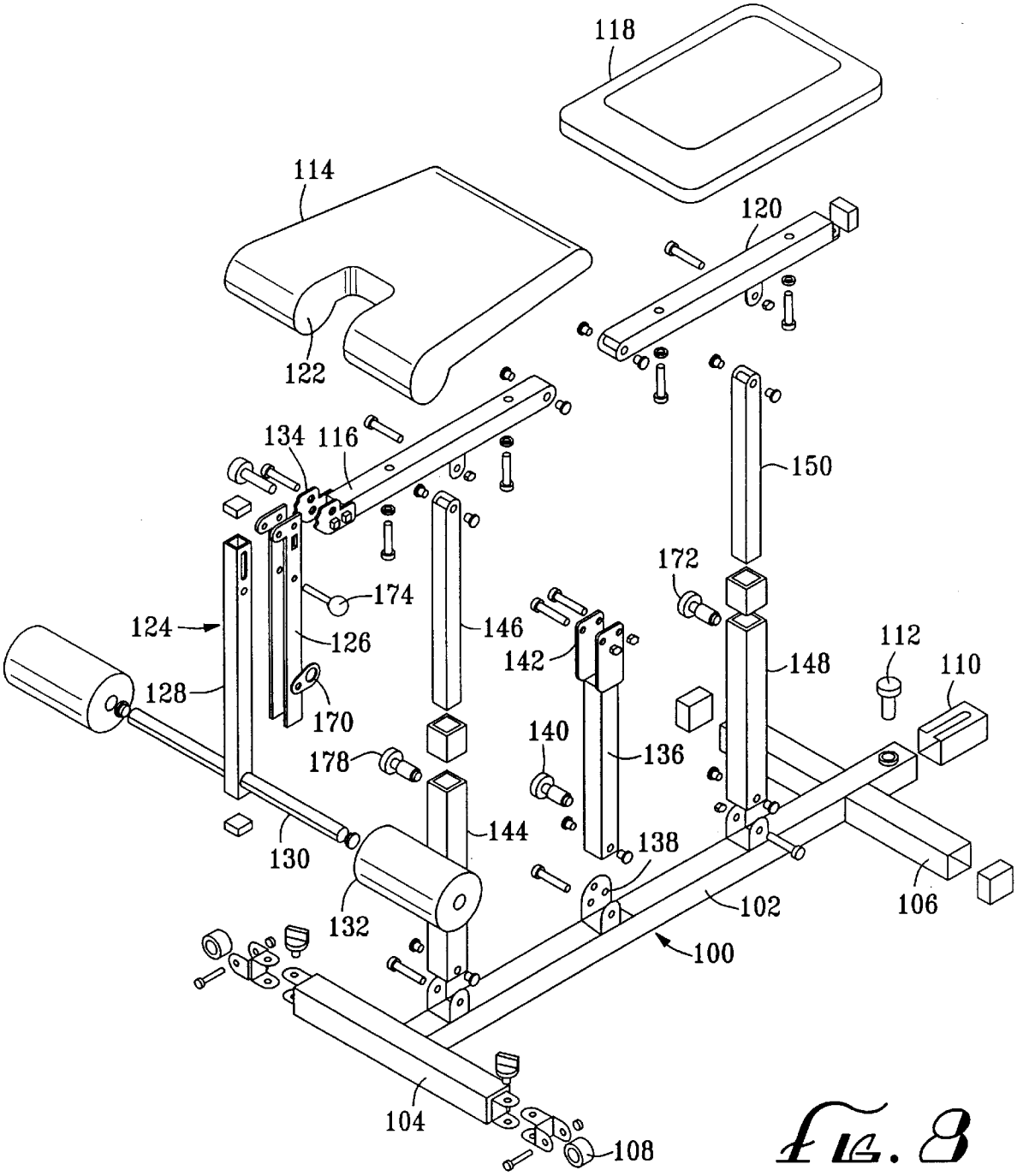
FIG. 8 is an exploded schematic view of the main frame.
Figure 11:
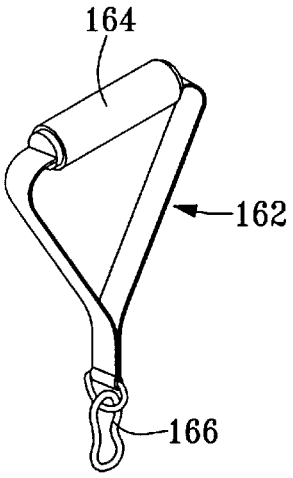
FIG. 11 is a detail perspective view of a hand grip.

Connected in front of the padded beam 16, are two padded rollers 8, one on each side of padded seat, as illustrated in FIGS. 1 and 4. These padded rollers will aid in keeping the underside of the users leg in comfort while exercising. At the end of the padded seat beam 16 are two braces 33. These braces pivotally connect the two piece pivotal leg 35 and 40 to the padded seat beam, by a pin in hole 28 (FIG. 4). The pivotal leg is made up of two pieces, with main pivotal leg 35 being able to fit snugly inside the three-sided pivotal leg brace 40. The main pivotal leg 35 has a pair of padded rollers 8 protruding from the bottom (FIGS. 1,4). These padded rollers are used to comfort the feet during exercise. The pivotal leg brace 41 is shorter in length to allow the main pivotal leg 35 to pivot in and out of it without conflict with the padded rollers 8, a shown in FIG. 8. The pivotal leg brace 41 also has a hook 21, which allows the resistance band(s) 56 to be hooked on when performing any leg exercise. In an inoperative state, the two piece pivotal leg is locked at a 25° angle to the padded seat beam by putting a pin through both pieces of the pivotal leg and hole 61, as shown in FIG. 2. While in an operative state, the two piece pivotal leg can be locked into four different positions. The first position is a sit-up position. A pin is put through hole 30, thus locking the two piece pivotal leg at a 90° angle to the padded seat. The seat angle is changed to F and the padded back angle is set at angle B, all shown in FIG. 3. This allows the user to perform sit-ups. The second position is for the exercise leg extension. A pin is placed in hole 54. The seat angle is set at angle F, shown in FIG. 3. The padded back is then set at angle D (FIG. 3). The eye hook 76 of the resistance band 56 is then hooked onto hook 21 of the pivotal leg brace 40. A user can then be seated and place his or her feet behind the padded rollers 8 and perform the leg extension exercise. The third position is when the main pivotal leg 35 is placed at a 90° angle (or close to 90°) to the pivotal leg brace 40. This angel can be locked into place by placing a pin through hole 45. The seat angle is set at E (FIG. 3). The padded back is set at angle A (FIG. 3). The resistance band eye(s) 76 are then hooked onto the hook on the other pivotal leg brace 410. The user then lies on the bench on his or her stomach, placing the heals of each foot on the underside of the padded rollers 8 on the main pivotal leg 35. A leg curl exercise can now be performed. The last position is to change the position of the exercise machine itself. A pin is placed in hole 30. The seat angle is set at angel G (FIG. 3). The padded back is set at either angle A or B (FIG. 3). The exercise machine is now placed in an upright position, as shown in FIG. 1. The padded rollers 8, on the pivotal leg 35, 40, now become the front leg supports themselves. The stoppers 17 on the end of the padded rollers 8 aid in support, as shown in FIG. 1. In this position the pivotal fork 4 and pivotal arms 9 can be set for a variety of exercises.

FIGS. 8 through 51 illustrate a second embodiment of exercise machine. The support base l00 includes a frame bar 102 and laterally extending base elements 104 and 106. Rollers 108 enhance portability. A base extension 110 is slidably extendable from the frame bar 102 and may be locked by a locking element 112.

The components associated with the main frame include a seat 114 mounted on a seat support bar 116. A seat back 118 also includes a support bar 120. The seat back 118 is illustrated in a single piece. The seat 114 relies on a padded element 122 rather than a second set of rollers.

A leg 124 is selectively pivotally mounted at one end of the seat 114. The leg 124 is provided as an assembly including a first portion and a second portion. The first portion 126 is a leg extension adapter which is a channel to receive the second leg portion 128. The second leg portion 128 is a bar extending beyond the length of the first portion 126 to receive a mounting rod 130 which in turn mounts rollers 132 to the distal end of the second portion 128. The first portion 126, the second portion 128 and a bracket 134 located on the end of the seat support bar 116 allow for various combinations of movement of the leg 124 relative to the seat support bar 116. The first portion 126 and the second portion 128 may be held together and fixed so as not to pivot. These elements may also be arranged at 90° and allowed to pivot. The second leg portion 128 may also be constrained from lowering below a horizontal extension from the seat 114.

The articulated support linkage provides and positions the seat support bar 116 and the seat back support bar 120. The linkage further provides a main beam 136 which is pivotally mounted to the support base 100 and to both the support bars 116 and 120. A stay 138 on the frame bar 102 both pivotally receives the main beam 136 and allows for it to be pivotally locked by means of a locking element 140. A bracket 142 on the other end of the main beam 136 cooperates with the support bars 116 and 120 to pivotally pin each of these element thereto. The main beam 136 does not elongate.

A front beam 144 is also pivotally mounted between the frame bar 102 and the seat support bar 116. The front beams 144 is extendable through a telescoping insert 146. The beam 144 is coupled with the seat support bar 116 at a distance from either end of the bar. Similarly, a rear beam 148 is pivotally coupled between the frame bar 102 and an inner point on the seat back support bar 120. The rear beam 148 is extendable with an insert 150.

An arm support 152 in the form of a fork is pivotally mounted to a stay 154 which is in turn fixed on the base extension 110 of the support base 100. This portion of the articulated support linkage provides for pivotal movement of the arm support 152 from a position extending substantially along the support base to one extending outwardly perpendicular to the base extension 110. Intermediate positions may also be chosen.

Arms 156 and 158 are pivotally mounted at the outer ends of the arm support 152. The arms 156 and 158 pivot about axes which are perpendicular to a plane extending through the mounting axis for the arm support 152 on the support base 100. This arrangement effectively allows the arms 156 and 158 to move toward one another or away from one another laterally of the centerline of the device. The arms are curved to permit them to closely approach the support base 100 in one of the several orientations of the system.

As with the first embodiment, a plurality of pulleys 160 are arranged on the arm support 152 and the arms 156 and 158. The outer pulleys 160 found on the arms 156 and 158 receive the ends of the resistance elements 56. The resistance elements are kept from withdrawing from the pulleys 160 by enlarged ends. The elements 56 extend from the outer pulleys 160 on the arms 156 and 158 through the other pulleys. Attachment eyes are provided on the ends of the resistance elements for attachment to elements for resistance to exercise movements.

Figure 12:
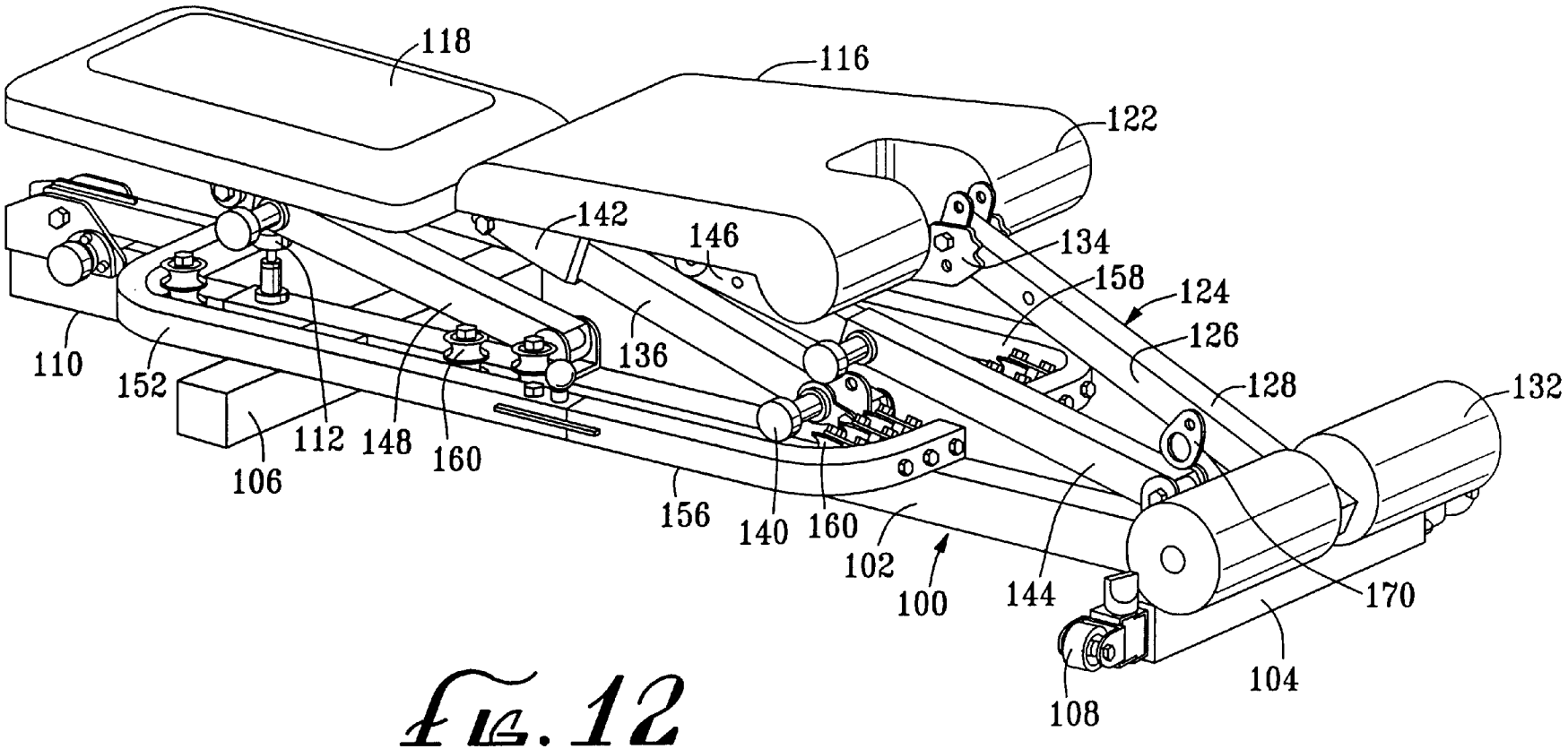
FIG. 12 is a perspective view of an exercise machine in the storage position.

Hand grips 162 are provided with the equipment. They typically include a rigid gripping portion 164 and an attachment clip 166 for attaching to one or more of the resistance elements 56. Turning to the several positions possible with the machine as described, a storage position is illustrated in FIG. 12. The storage position illustrates that the arms 156 and 158 extend substantially along the support base 100. Further, the base extension 110 is telescoped inwardly to present the shortest link. The seat 114 and the seat back 118 are arranged to be substantially coplanar. They are also compactly placed adjacent the support base 100 in a parallel arrangement through a pivoting of the main beam 136, the front beam 144 and the rear beam 148. The leg 124 is pivoted upwardly from a vertically depending position so as to extend from the seat structure down to the support base 100 in the most compact way. Thus, the several articulated support linkage elements presents a storage position which is thin, compact and of a minimum length. The locking element 140 may be employed with the stay 138 to lock the machine in the storage position.

Figure 13:
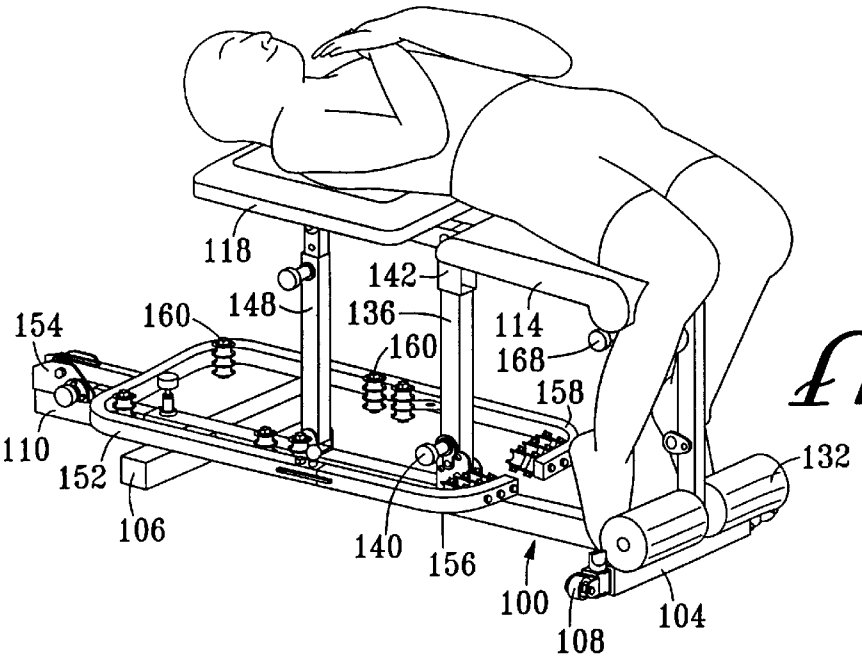
FIG. 13 is a perspective view of the exercise machine in the sit-up exercise position with a figure shown in a first position.
Figure 14:
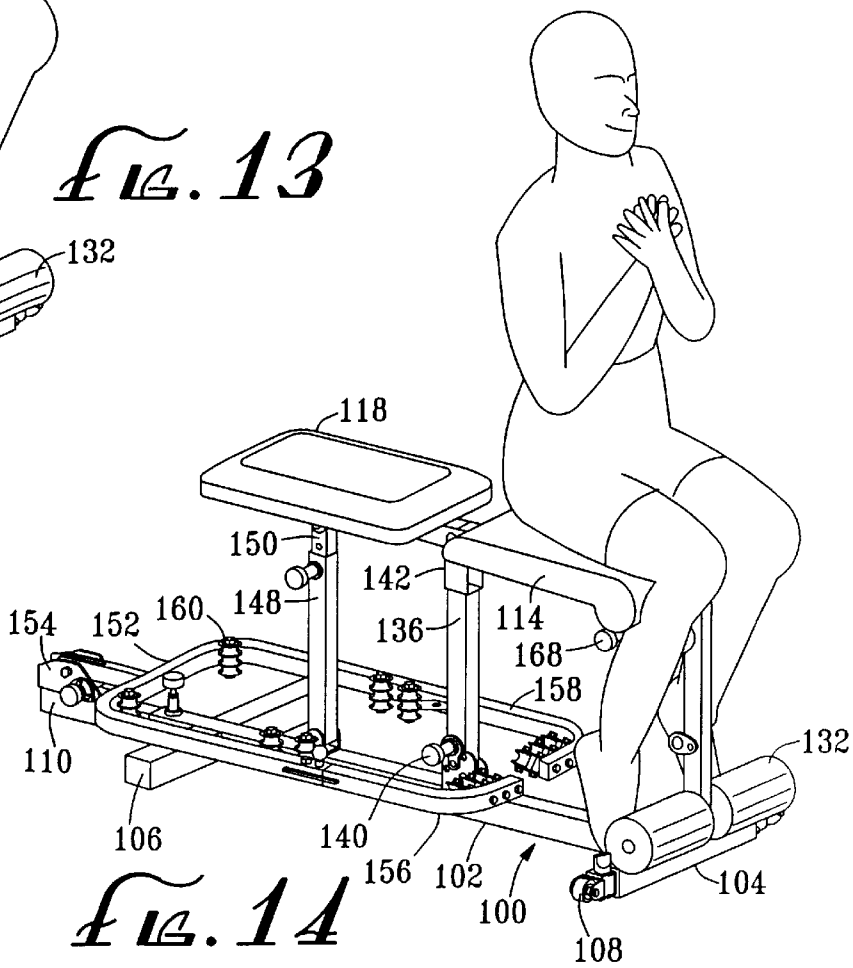
FIG. 14 is the device as positioned in FIG. 13 with the figure in a second position.
Figure 15:
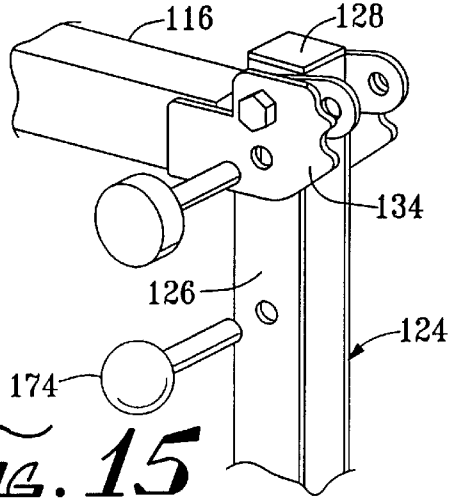
FIG. 15 is a detail perspective view of the leg lock employed in the position of the device illustrated in FIGS. 13 and 14.

In FIGS. 13–15, a sit-up exercise position is illustrated. The articulated support linkage again is arranged with the seat 114 and seat back 118 in a coplanar orientation. However, the beams 136, 144 and 148 have been rotated to a vertical position. The leg 124 has been positioned to extend vertically downwardly from the seat 114 and a locking element 168 has been associated with the bracket 134 to retain the leg 124 in that position. The arms 156 and 158 may remain in the compact position at the support base 100. The rollers 132 provide a position to comfortably engage the feet for purposes of performing sit-ups.

Figure 16:
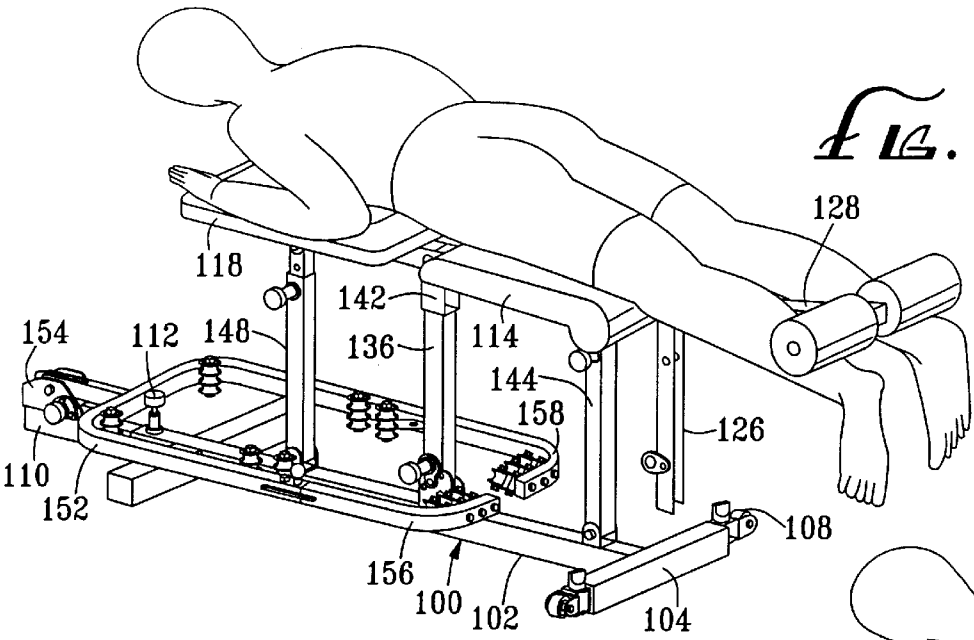
FIG. 16 is a perspective view of the exercise machine in the leg curl exercise position with a figure shown in a first position.
Figure 17:
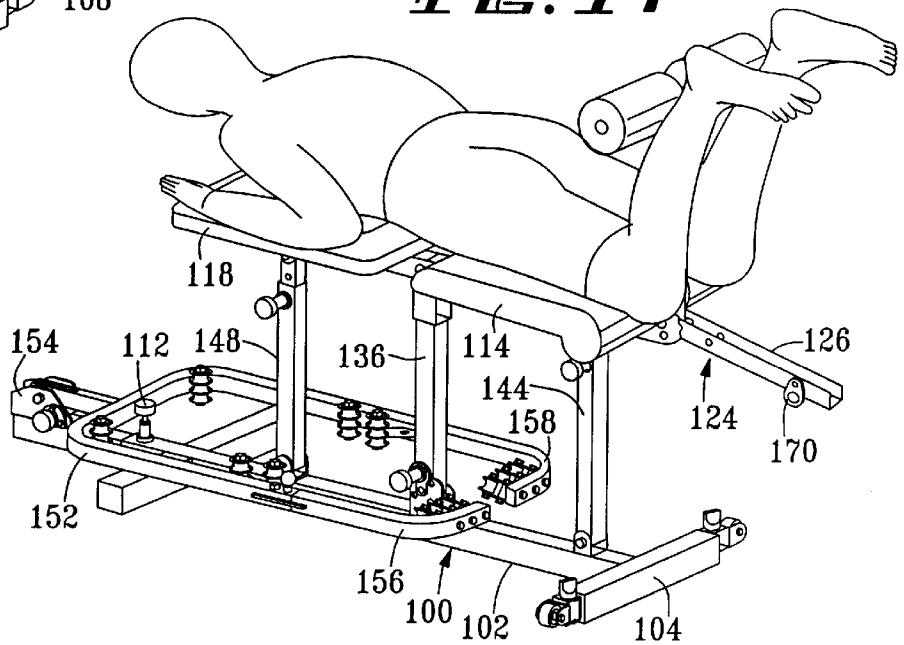
FIG. 17 is the device as positioned in FIG. 16 with the figure in a second position.
Figure 18:
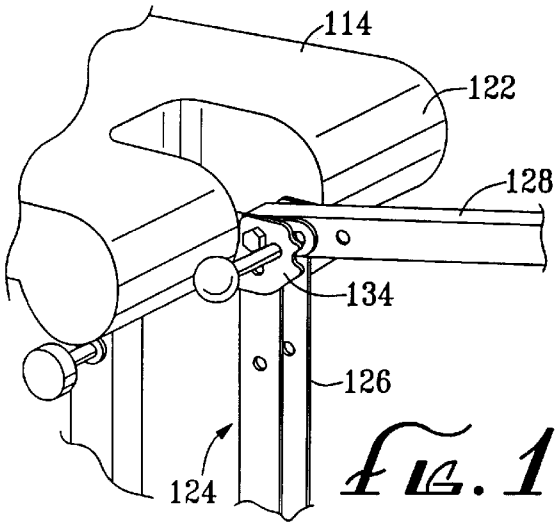
FIG. 18 is a detail perspective view of the leg lock employed in the position of the device illustrated in FIGS. 16 and 17.
Figures 19, 20, 21:
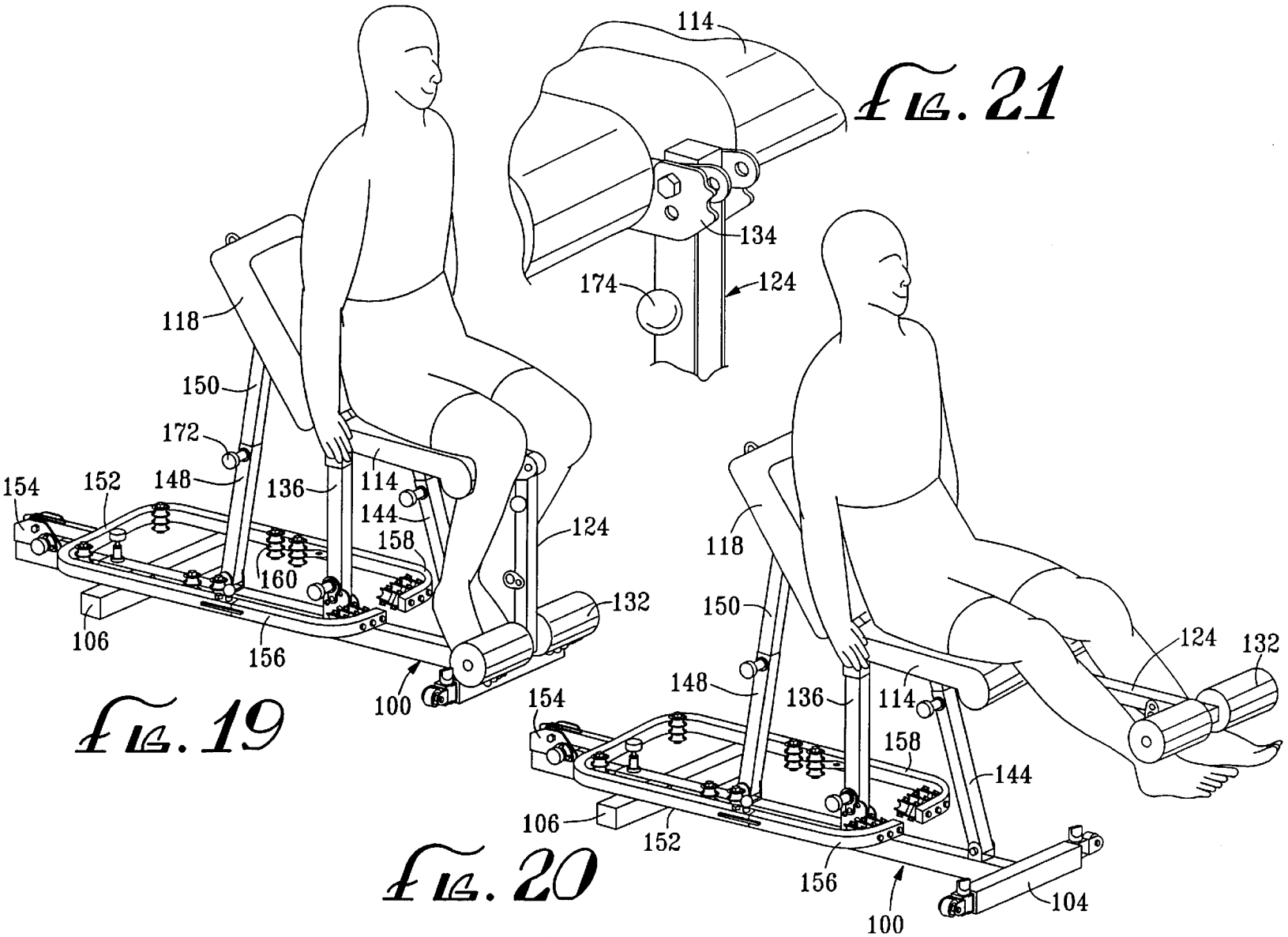
FIG. 19 is a perspective view of the exercise machine in the leg extension exercise position with a figure shown in a first position.
FIG. 20 is the device as positioned in FIG. 19 with the figure in a second position.
FIG. 21 is a detail perspective view of the leg lock employed in the position of the device illustrated in FIGS. 1 and 20.

In FIGS. 16–18, a leg curl exercise position is achieved. Again, the arms 156 and 158 may remain in the compact orientation of the prior positions. The seat 114 and seat back 118 remain coplanar and parallel to the support base 100. The leg 124 is changed such that the first portion 126 is pivotally locked relative to the second portion 128 in a substantially 90° angle. Thus, the second portion 128 extends substantially horizontally at rest. The first portion 126 depends substantially vertically in the rest position. The ends of the resistance elements 56 are hooked to the eyelet 170. The number of resistance elements employed determines the amount of force required to perform the leg curl. If there are three such resistance elements associated with the arms 156 and 158, any number of ends from one to six may be hooked to the eyelet 170 with each addition providing an incremental increase in resistance force.

Figure 22:
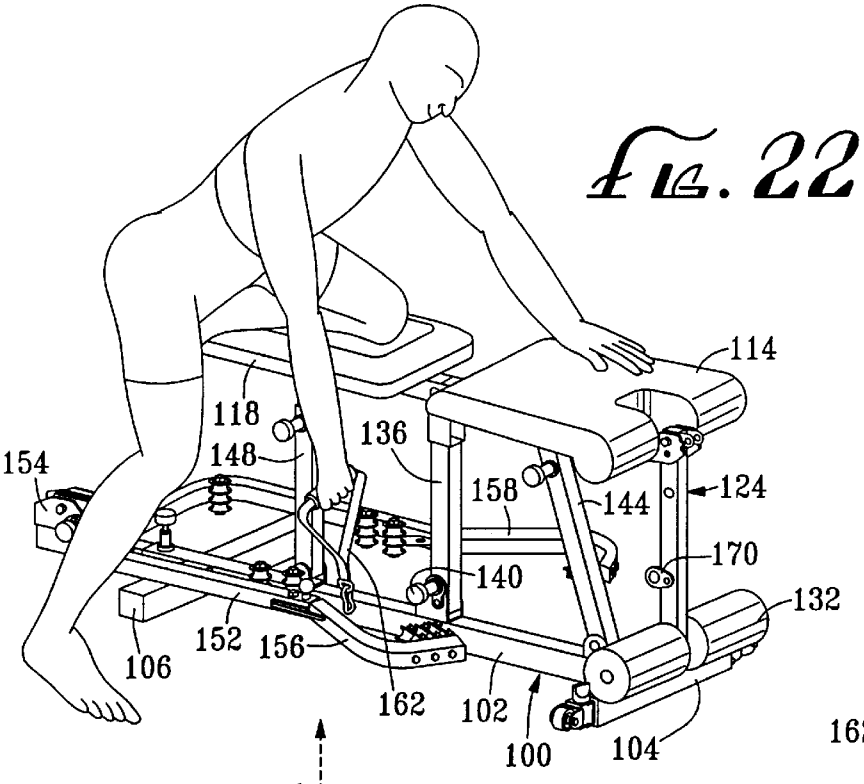
FIG. 22 is a perspective view of the exercise machine in the bent over row exercise position with a figure shown in a first position.
Figure 23:
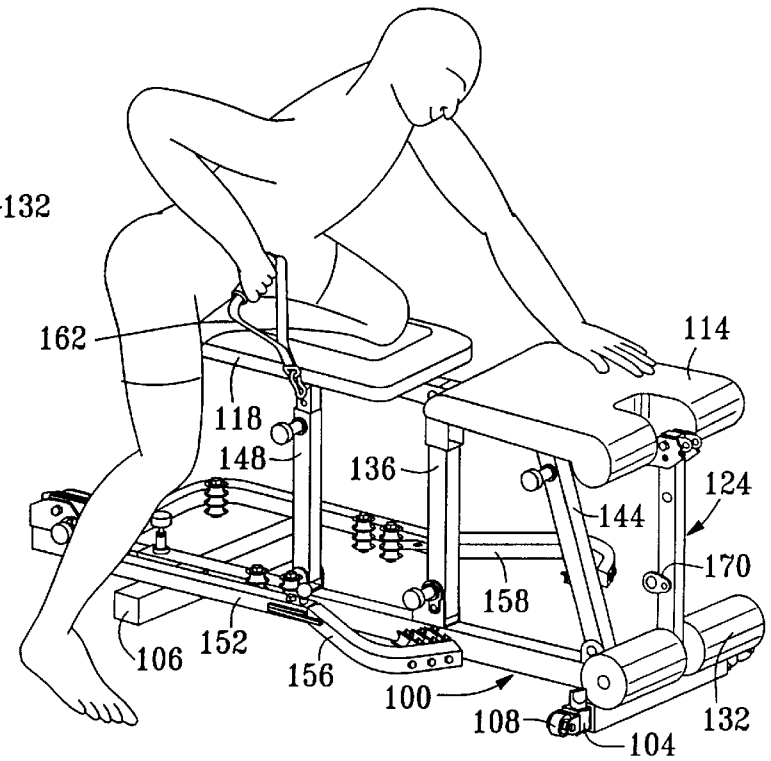
FIG. 23 is the device as positioned in FIG. 22 with the figure in a second position.
Figure 24:
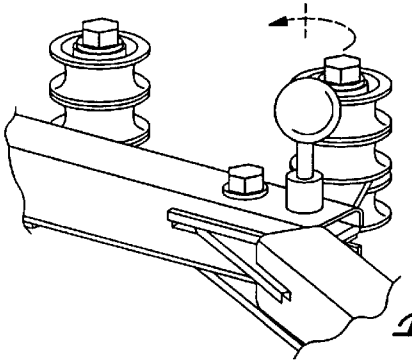
FIG. 24 is a detail perspective view of the pulley element employed in the position of the device illustrated in FIGS. 22 and 23.

Turning to FIGS. 22–24, a leg extension exercise position is illustrated. This arrangement again has the arms 156 and 158 positioned adjacent the support base 100. The rear beam 148 is extended and locked in position by a locking element 172 such that the seat back 118 is arranged at an oblique angle with the seat 114. The leg 124 is arranged with the first portion 126 and the second portion 128 locked together by a locking pin 174. The leg 124 is arranged to depend vertically downwardly in the rest position. Resistance elements again may be attached to the eyelet 170 as in the prior position.

A bent over row exercise position is illustrated in FIGS. 22–24. A hand grip 162 is added to the equipment with the seat 114 and seat back 118 in a coplanar horizontal position. The resistance elements are attached to the hand grip 162 to provide resistance force. In this exercise position, only the ends of the resistance elements terminating at one of the arms may be employed.

Figure 26:
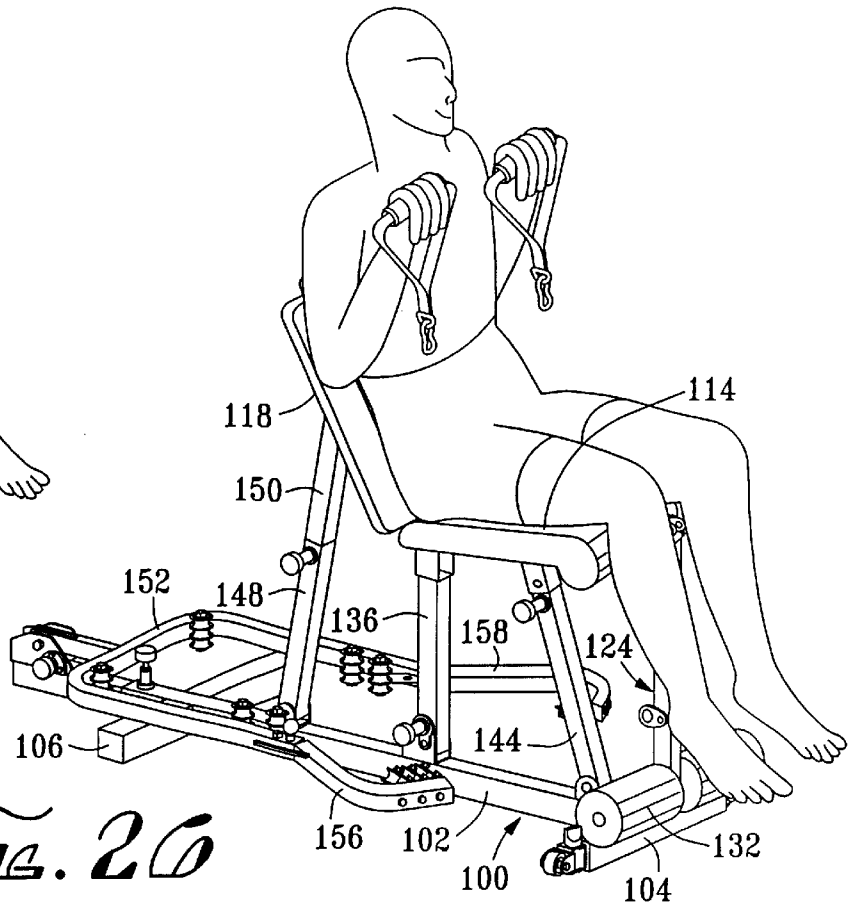
FIG. 26 is the device as positioned in FIG. 25 with the figure in a second position.
Figure 25:
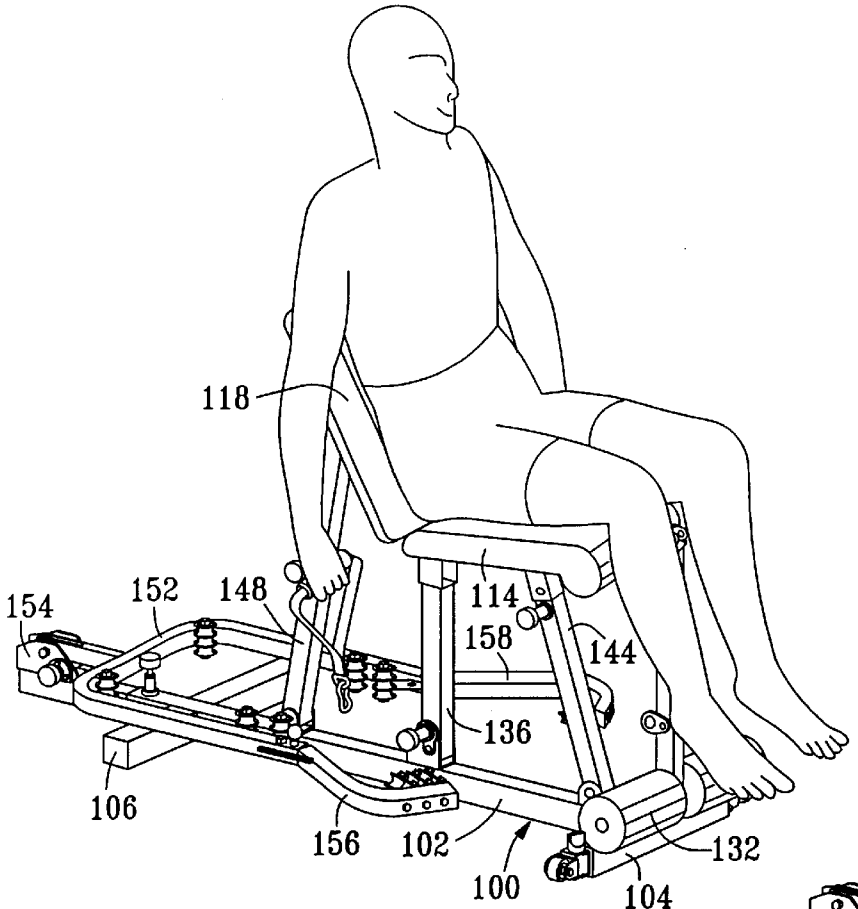
FIG. 25 is a perspective view of the exercise machine in the seated arm curl exercise position with a figure shown in a first position.
Figure 28:
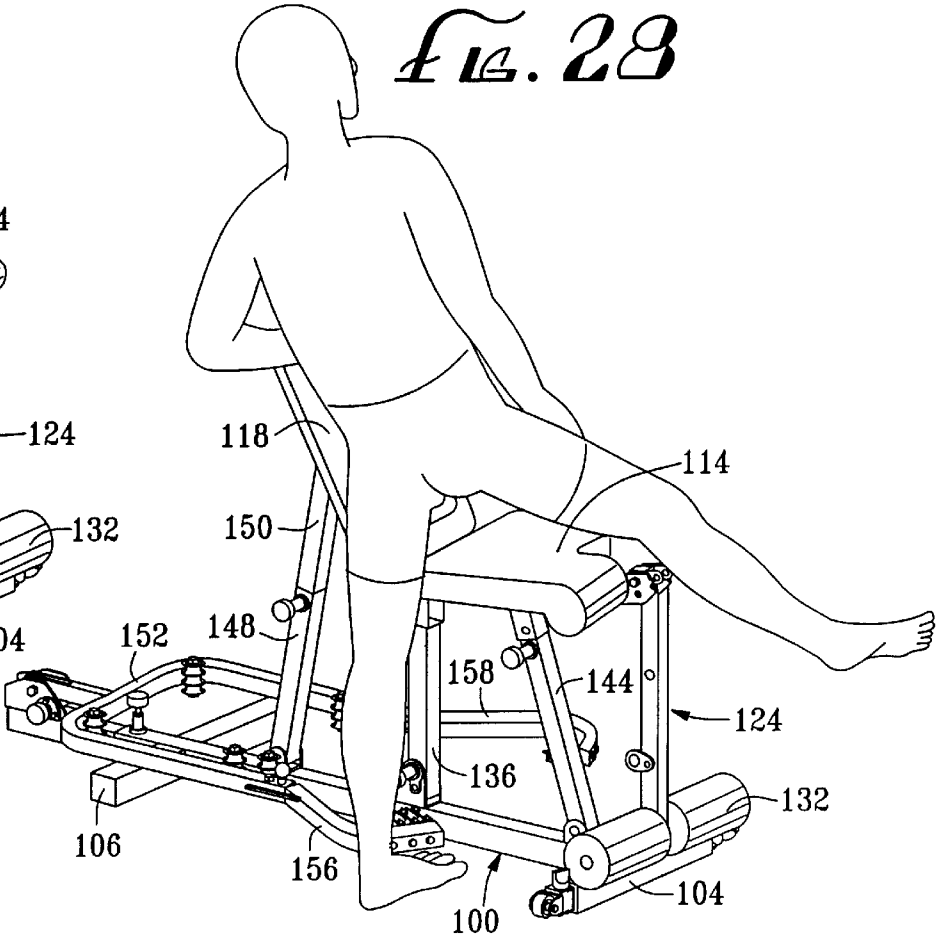
FIG. 28 is the device as positioned in FIG. 27 with the figure in a second position.
Figure 27:
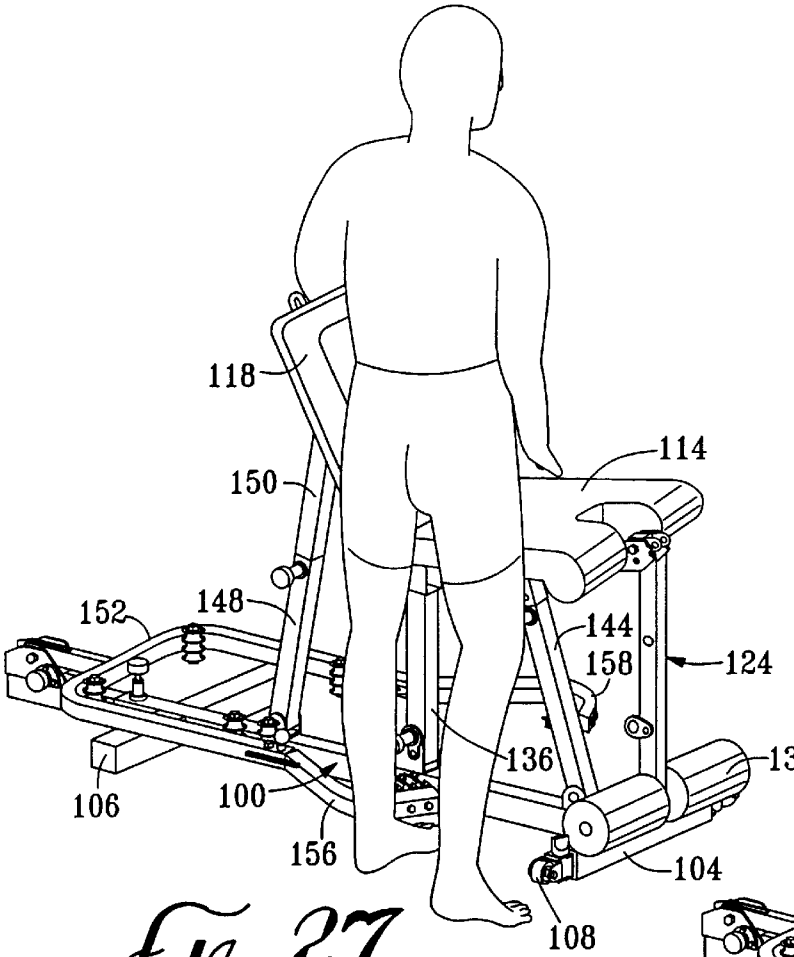
FIG. 27 is a perspective view of the exercise machine in the leg abduction (outer) exercise position with a figure shown in a first position.
Figure 30:
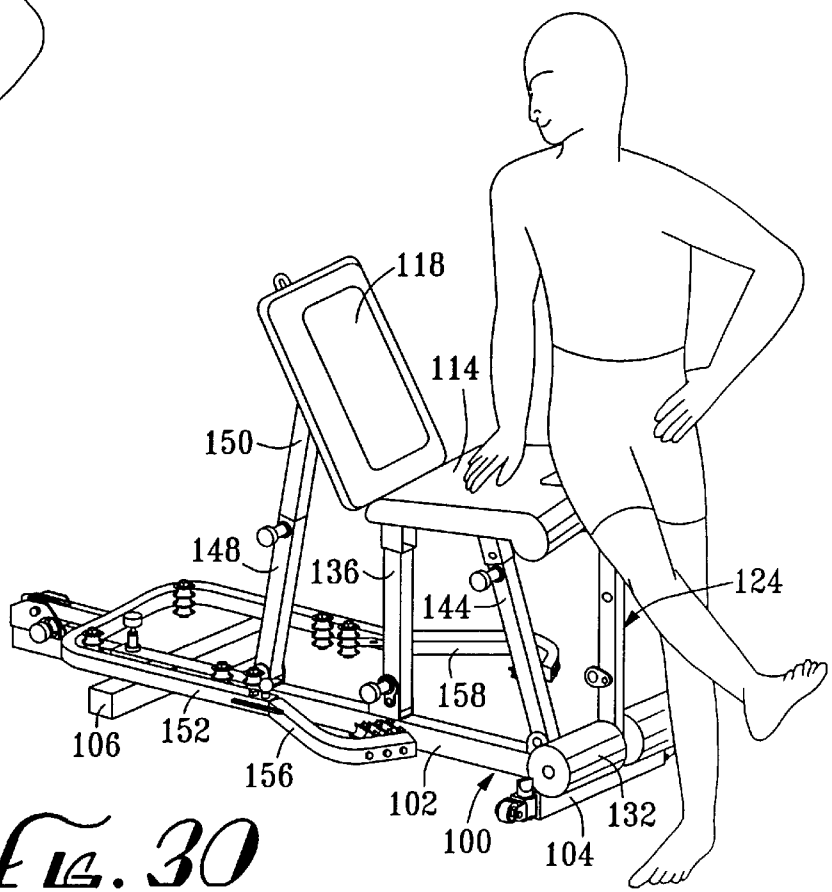
FIG. 30 is the device as positioned in FIG. 29 with the figure in a second position.
Figure 29:
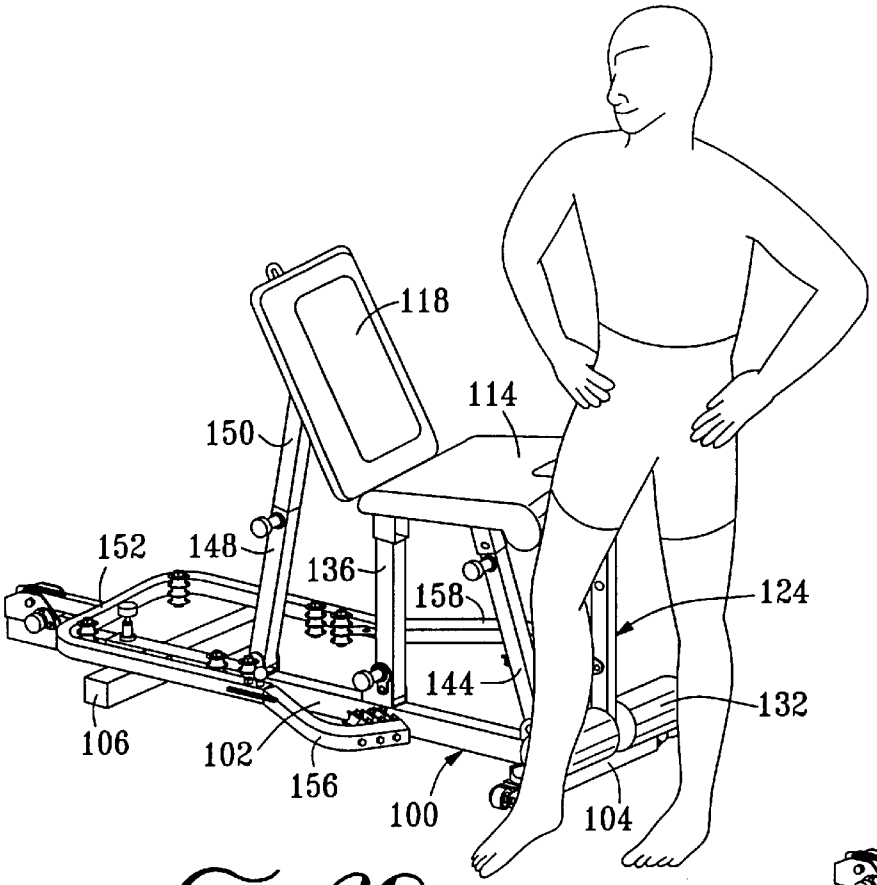
FIG. 29 is a perspective view of the exercise machine in the leg abduction (inner) exercise position with a figure shown in a first position.

In FIGS. 25–26, a seated arm curl exercise position is illustrated. The seat back 118 is oriented as in the leg extension exercise position while the arms 156 and 158 may be pivoted outwardly to an appropriate and comfortable position. This position is likely also to apply to the bent over row exercise position. With the machine remaining in the seated arm curl exercise position, leg abduction (outer) and leg abduction (inner) may be performed through the use of leg bands rather than the hand grips 162 employed with the seated arm curls exercise position. Multipurpose grips may also apply. These further exercises are illustrated in FIGS. 27–30.

Figure 32:
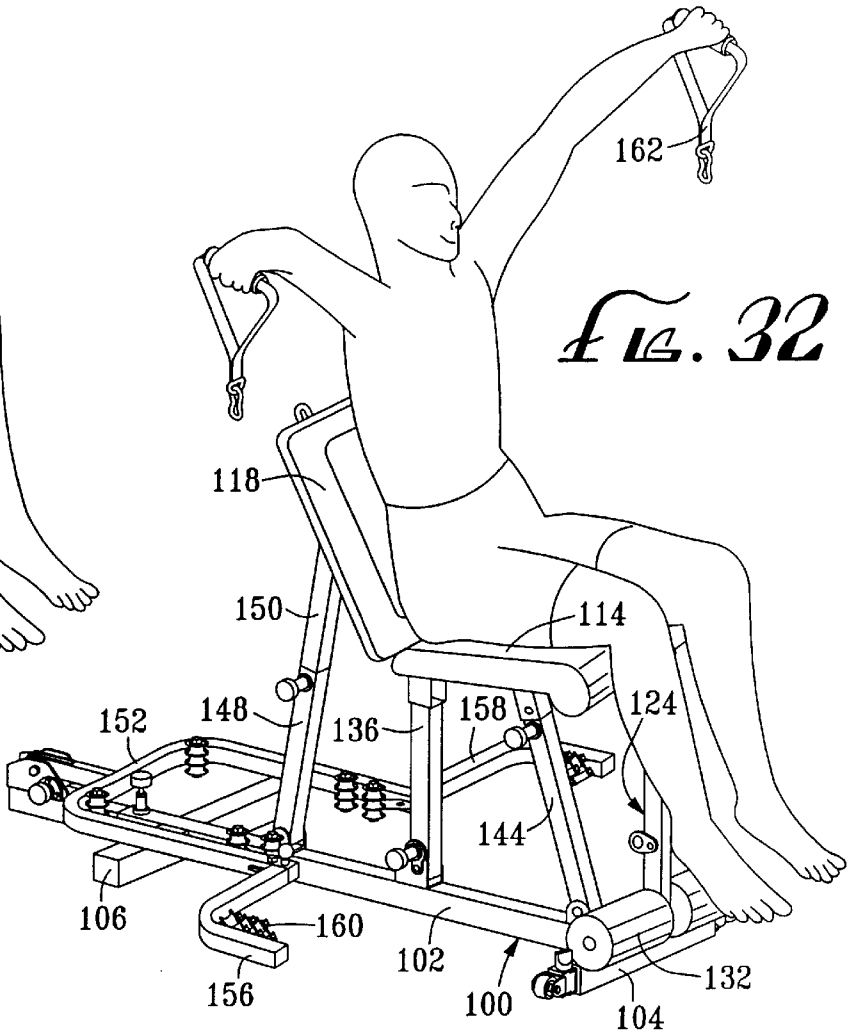
FIG. 32 is the device as positioned in FIG. 31 with the figure in a second position.
Figure 31:
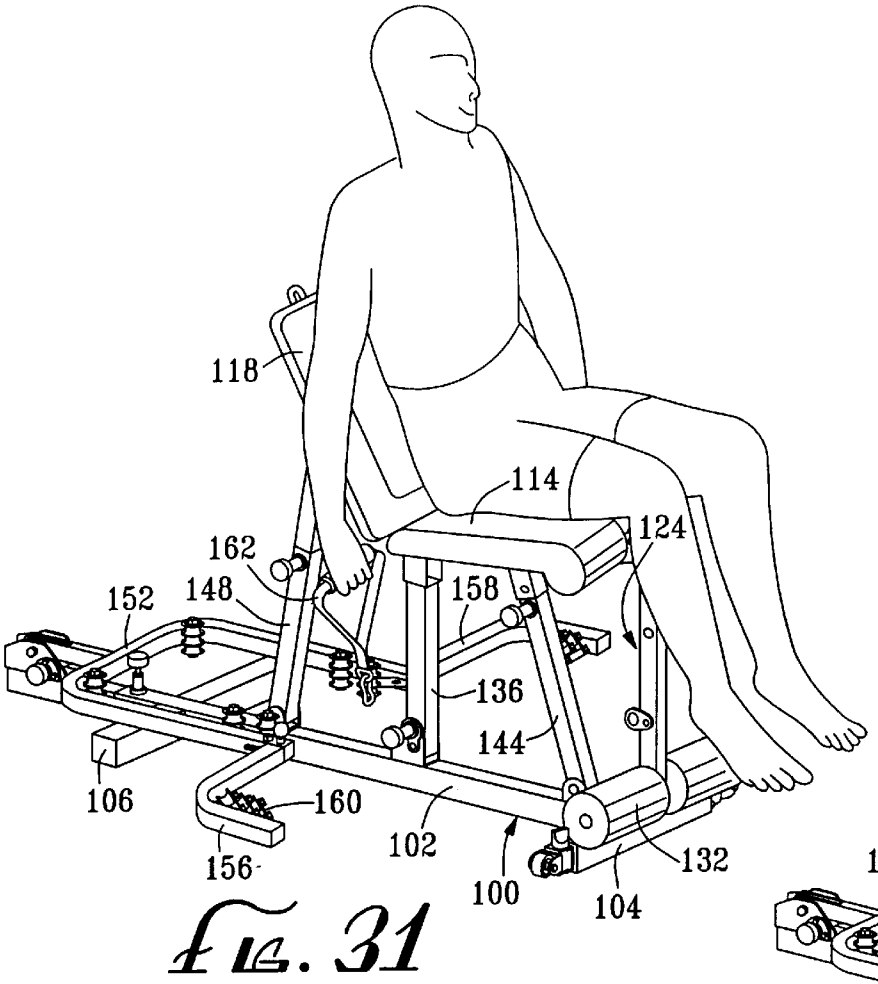
FIG. 31 is a perspective view of the exercise machine in the lateral arm raise exercise position with a figure shown in a first position.

A slightly different orientation of the system as employed for the seated arm curls is used for the lateral arm raise exercise position as illustrated in FIGS. 31–32. The arms 156 and 158 are shown to be rotated outwardly to match the greater spread of the arms as employed with this exercise.

Figures 33, 34, 35:
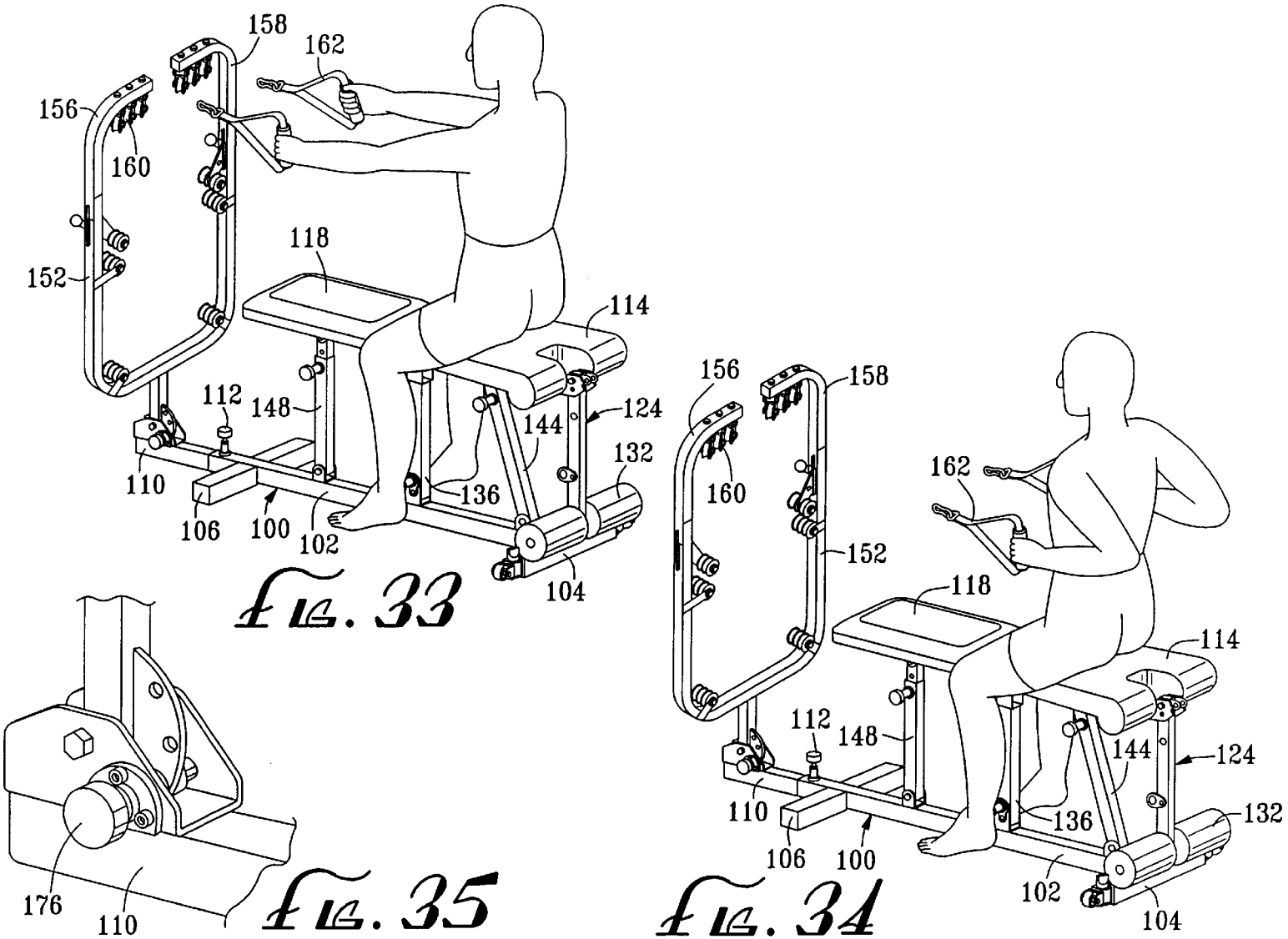
FIG. 33 is a perspective view of the exercise machine in the seated row exercise position with a figure shown in a first position.
FIG. 34 is the device as positioned in FIG. 33 with the figure in a second position.
FIG. 35 is a detail perspective view of the arm support lock employed in the position of the device illustrated in FIGS. 33 and 34.

The seated row exercise position is illustrated in FIGS. 33–35. The seat back 118 is most conveniently in a horizontal position. The arm support 152 is pivoted about the horizontal axis transverse to the frame bar 102 so that it extends upwardly from the support base 100. The arms 156 and 158 are pivotally positioned about the axes arranged perpendicularly to a plane extending through the mounting axis for the arm support 152 to best adjust to the user's most comfortable width. The base extension 110 is adjusted outwardly and held in place by the locking element 112 so as to provide a comfortable initial position for the user. Hand grips 162 are associated with the two ends of the resistance elements so that a uniform resistance force is created. As can be seen in the detail, a locking element 176 provides for retention of the vertical orientation of the arm support 152.

A number of the following exercises are performed by tipping the entire mechanism upwardly so that the support base 100 extends vertically. To achieve stability, the base element 104 is positioned at the end of the frame bar 102. Further, the leg 124 is locked in position vertically depending from the seat 114. Thus, the rollers 132 cooperate with the base element 104 to provide a stable support position. Through extension of the front beam 144, the seat 114 may be reoriented to a perpendicular position relative to the vertical frame bar 102. A locking element 178 retains the extension of the front beam 144.

Figure 37:
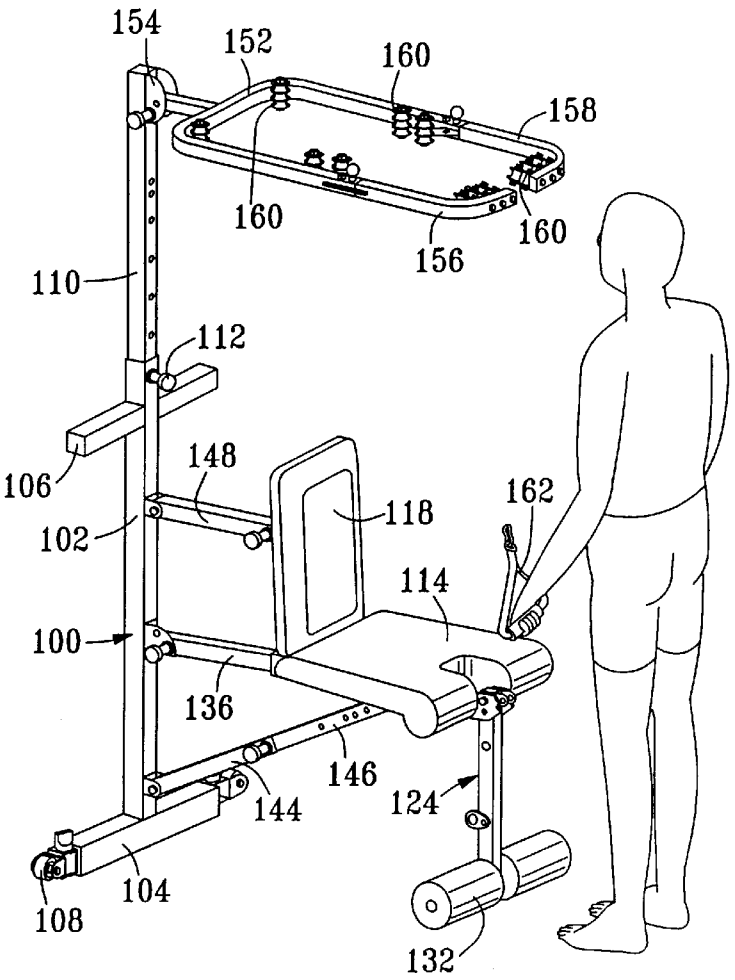
FIG. 37 is the device as positioned in FIG. 36 with the figure in a second position.
Figure 36:
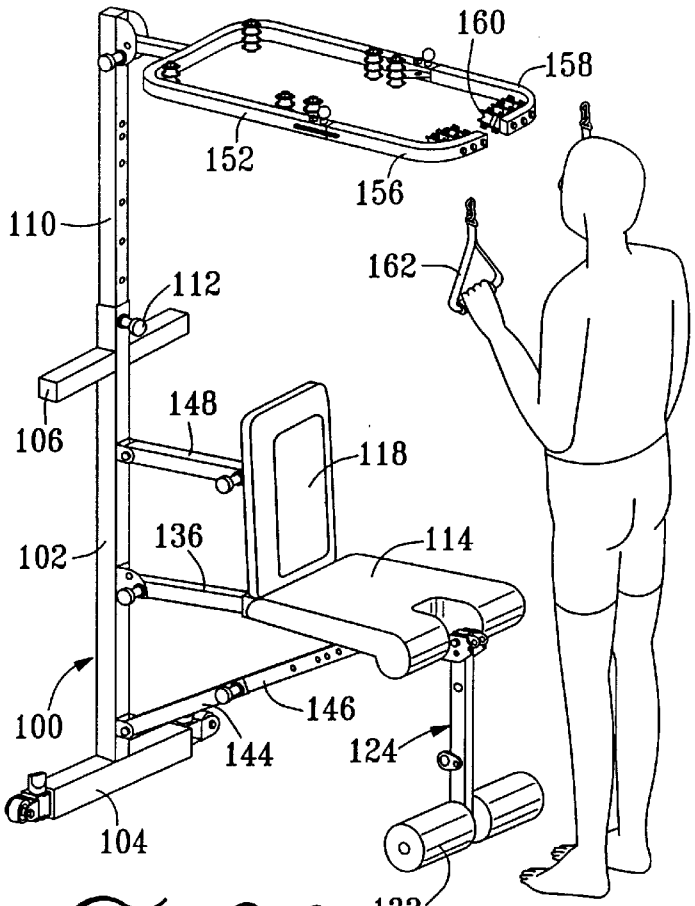
FIG. 36 is a perspective view of the exercise machine in the tricep extension position with a figure shown in a first position.

In FIGS. 36–37, a tricep extension exercise position is illustrated with the arm support 152 arranged to extend outwardly from the support base 100 and with the arms 156 and 158 shown in their rotated inwardly position. Hand grips 162 link with resistance elements.

Figure 39:
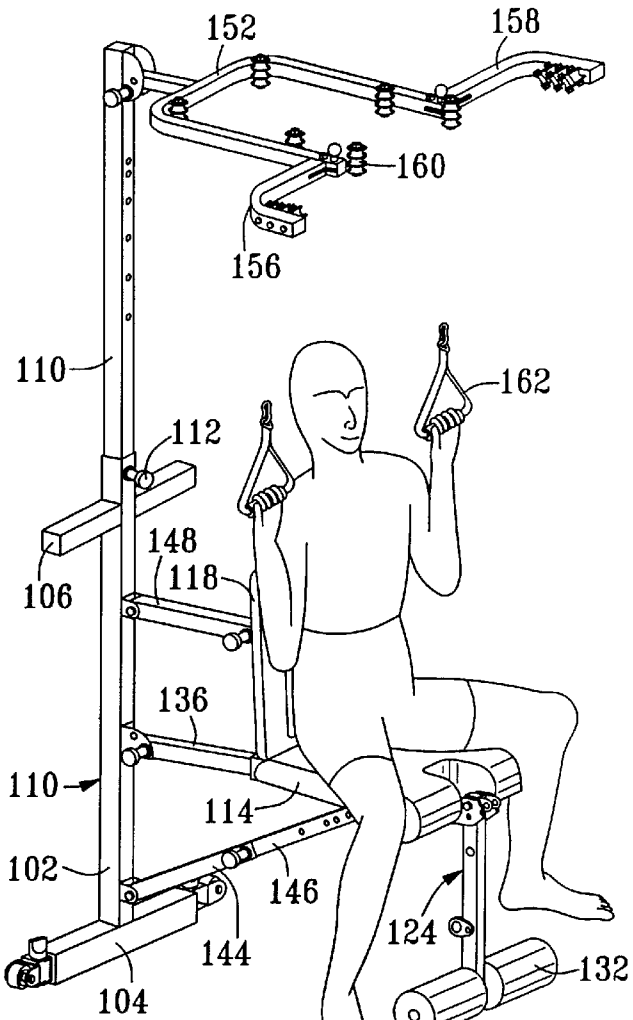
FIG. 39 is the device as positioned in FIG. 38 with the figure in a second position.
Figure 38:
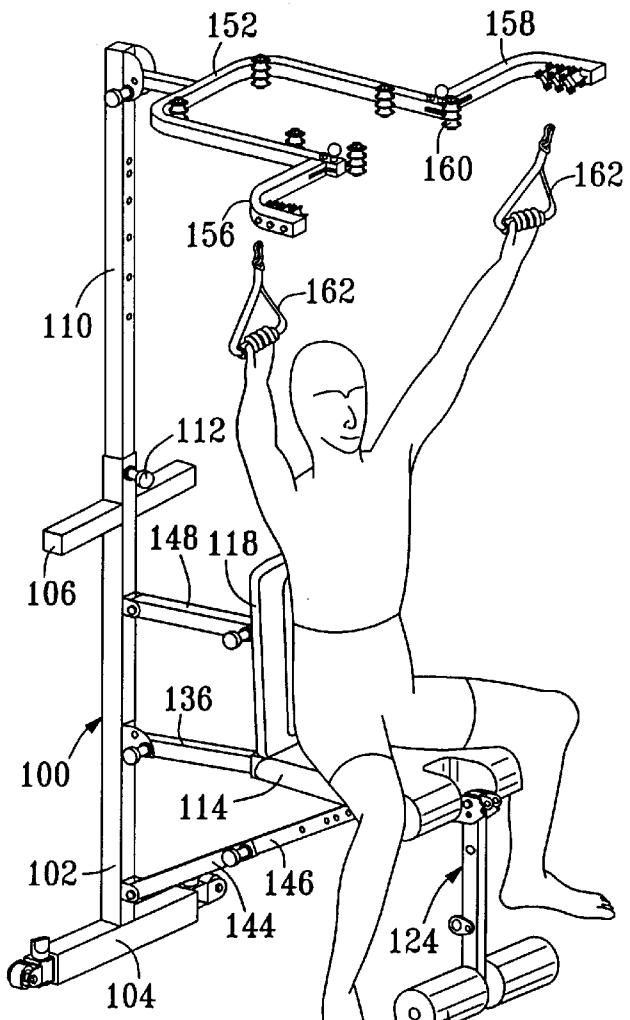
FIG. 38 is a perspective view of the exercise machine in the lat pull exercise position with a figure shown in a first position.
Figure 41:
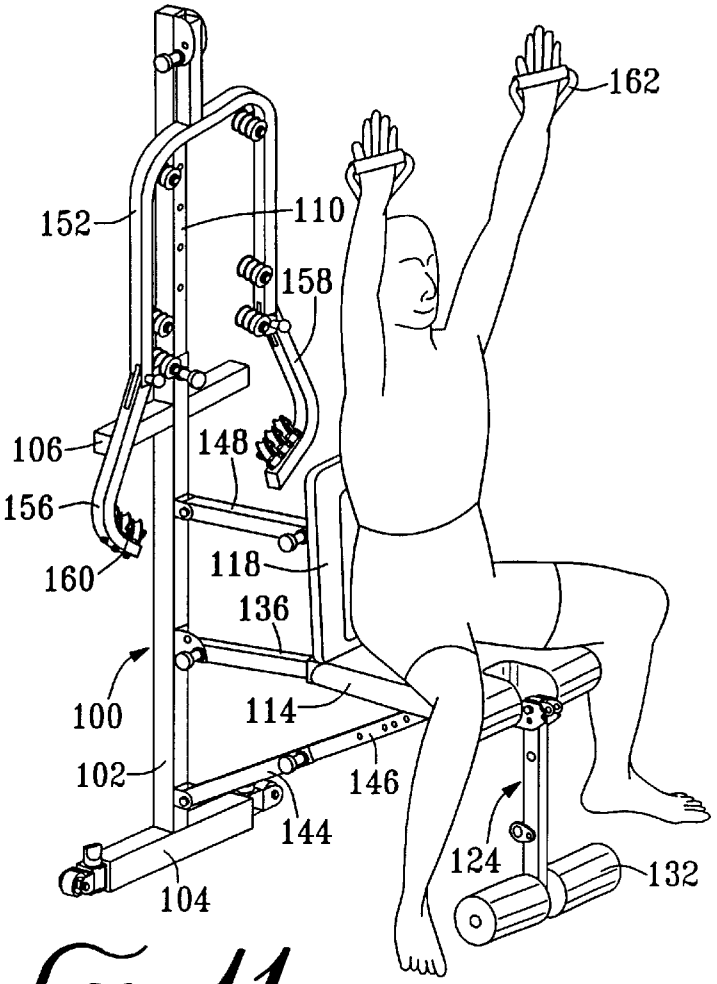
FIG. 41 is the device as positioned in FIG. 40 with the figure in a second position.
Figure 40:
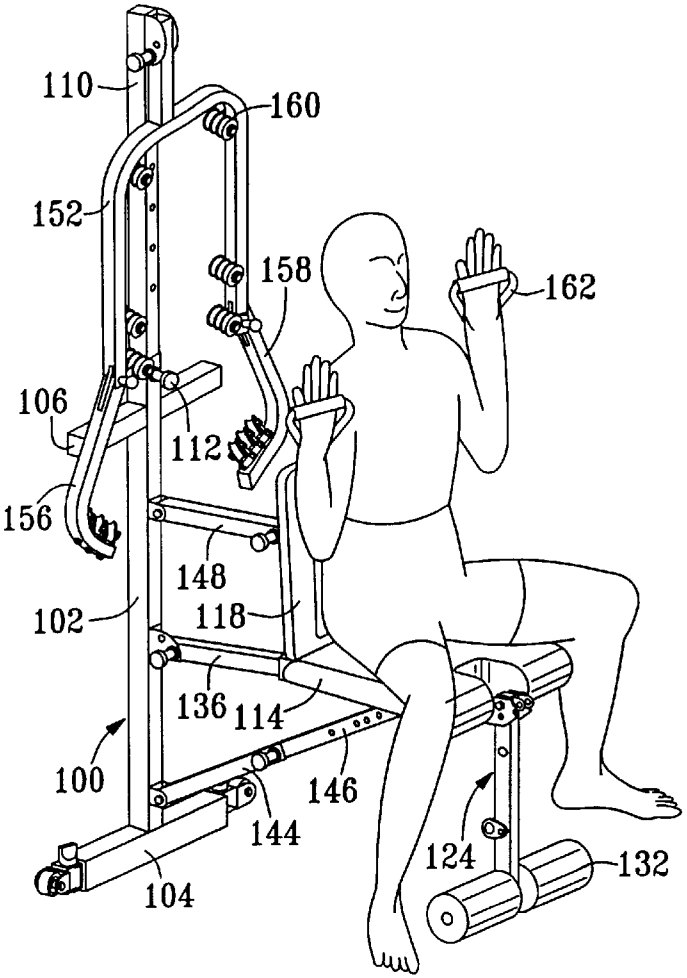
FIG. 40 is a perspective view of the exercise machine in the military press exercise position with a figure shown in a first position.
Figure 43:
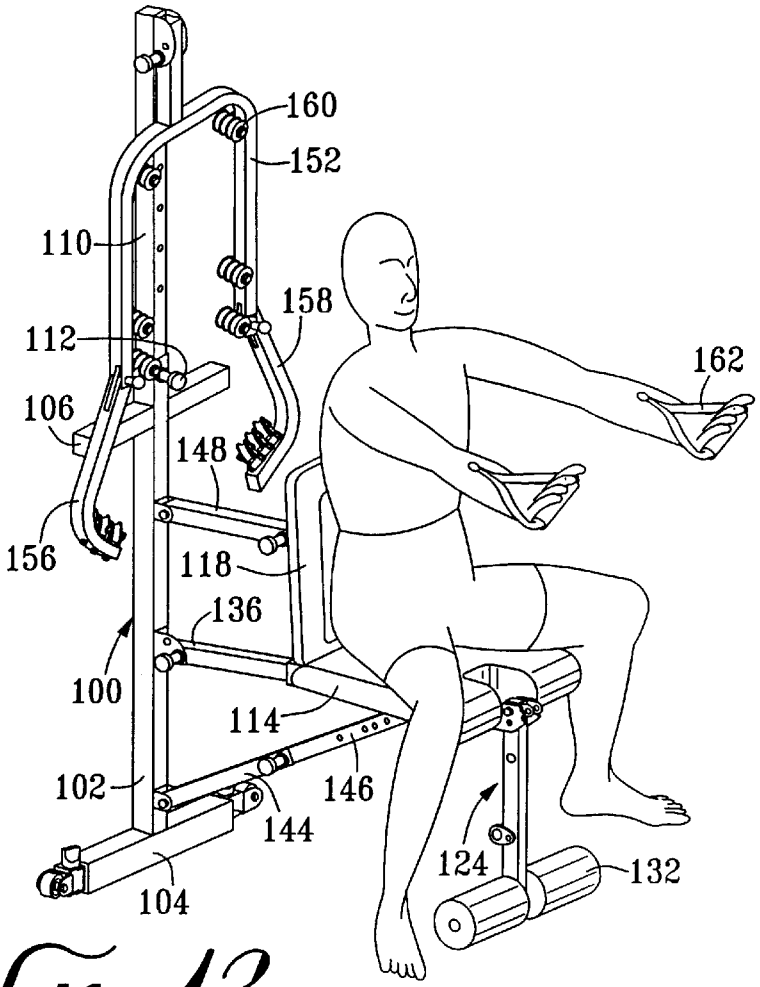
FIG. 43 is the device as positioned in FIG. 45 with the figure in a second position.
Figure 42:
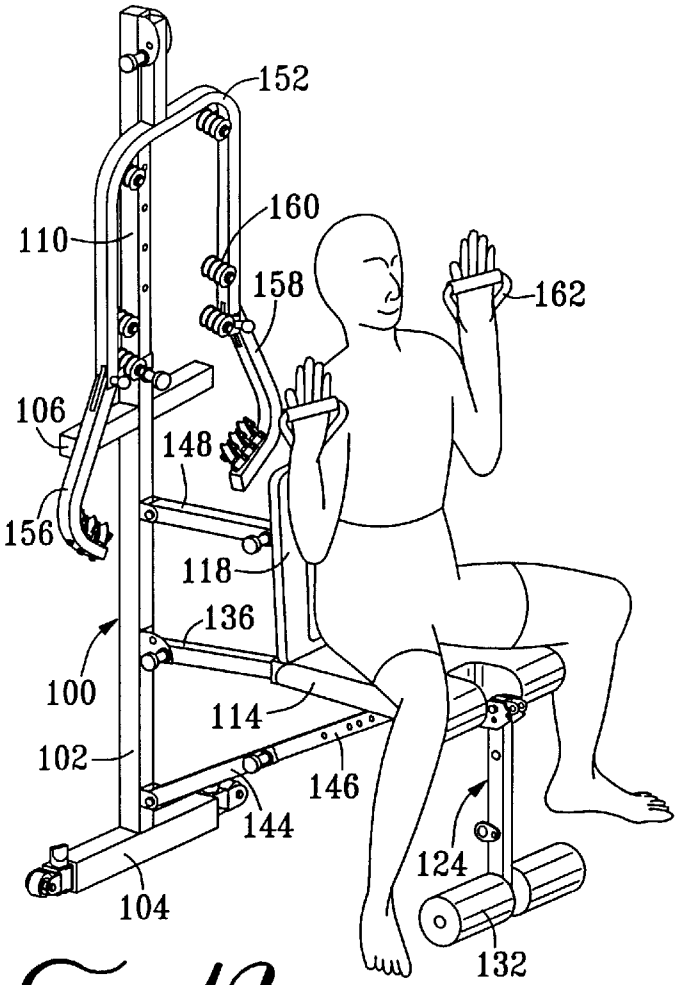
FIG. 42 is a perspective view of the exercise machine in the bench press exercise position with a figure shown in a first position.
Figure 45:
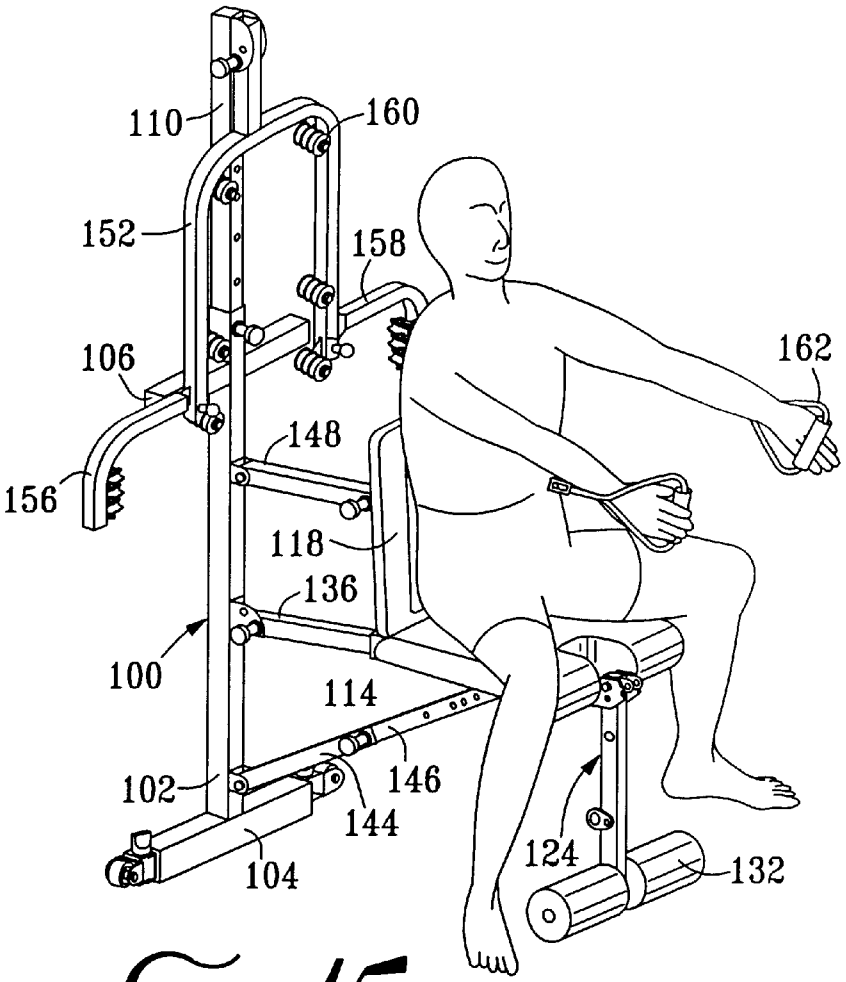
FIG. 45 is the device as positioned in FIG. 44 with the figure in a second position.
Figure 44:
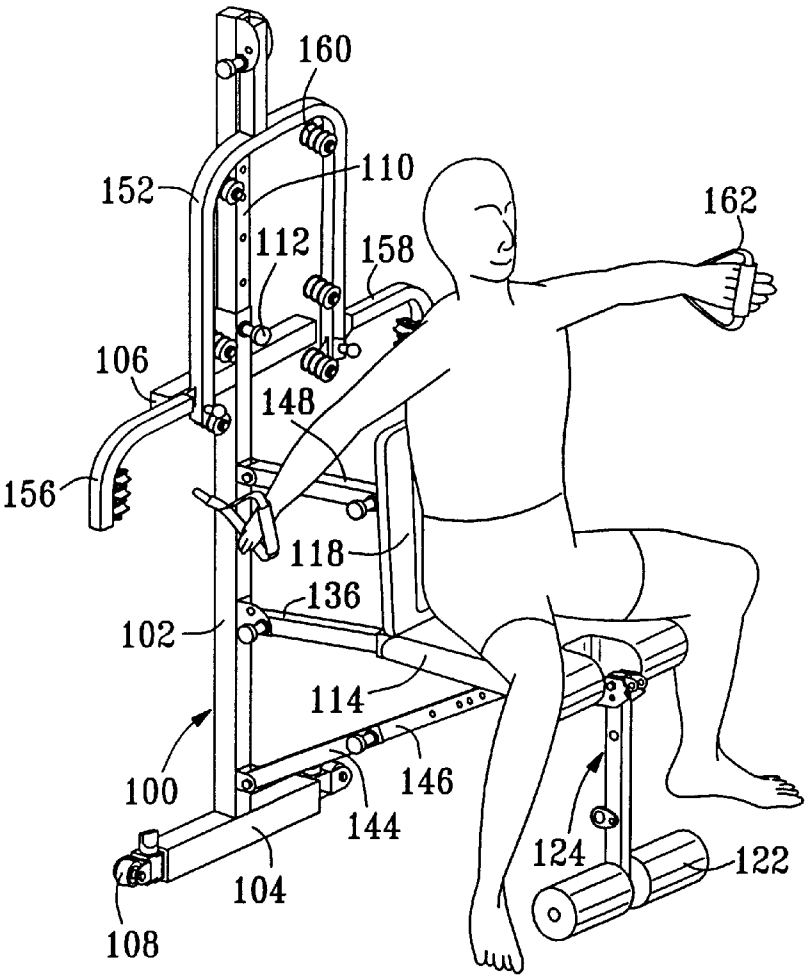
FIG. 44 is a perspective view of the exercise machine in the butterfly exercise position with a figure shown in a first position.
Figure 47:
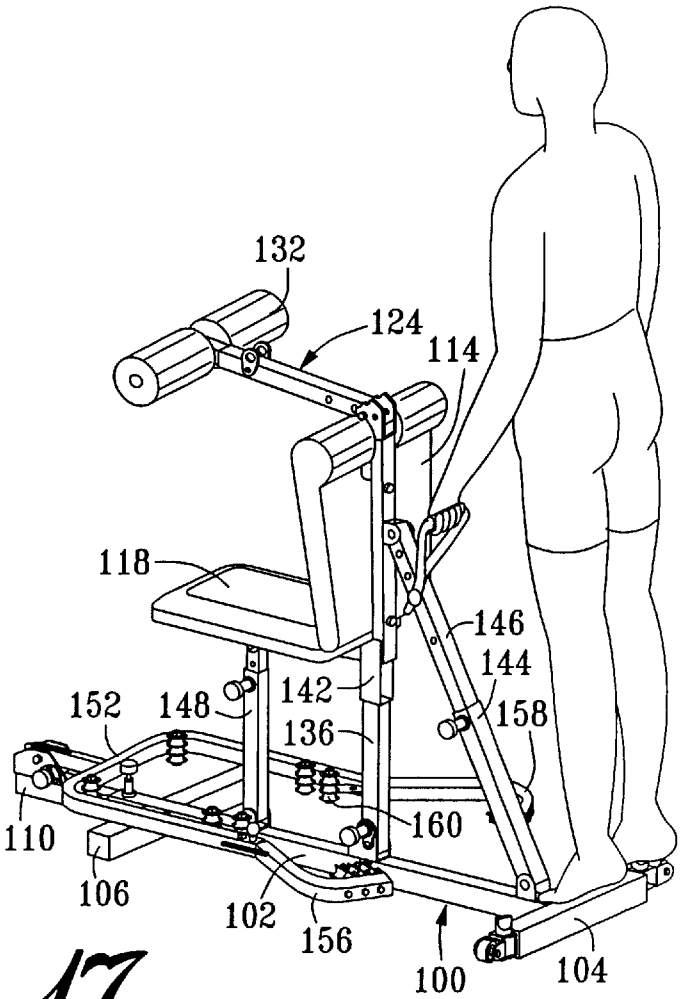
FIG. 47 is the device as positioned in FIG. 46 with the figure in a second position.
Figure 46:
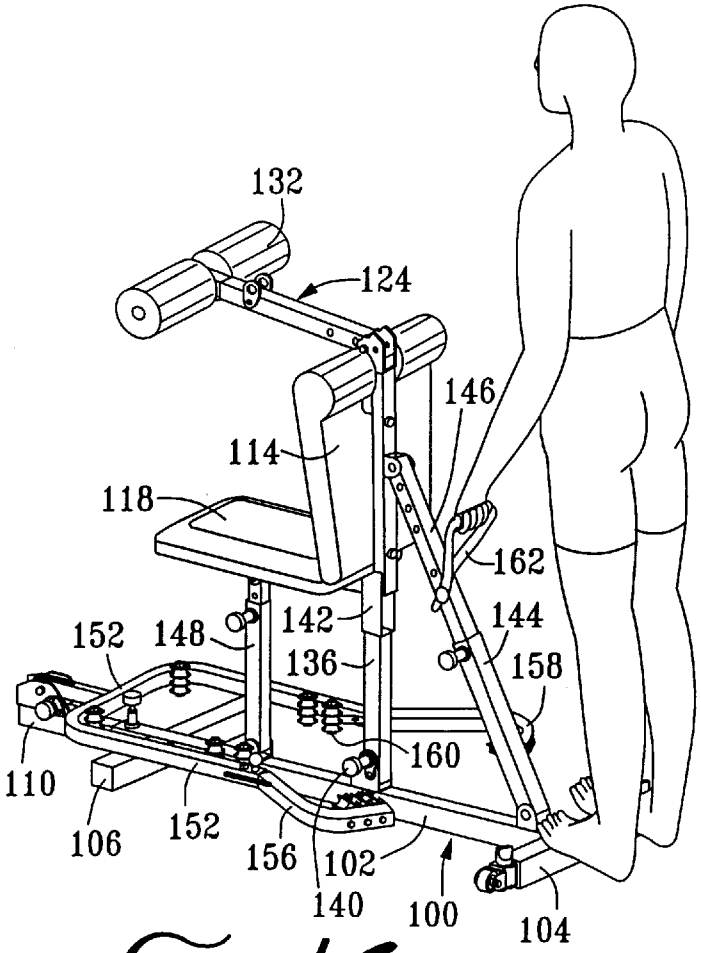
FIG. 46 is a perspective view of the exercise machine in the calf raise exercise position with a figure shown in a first position.
Figure 49:
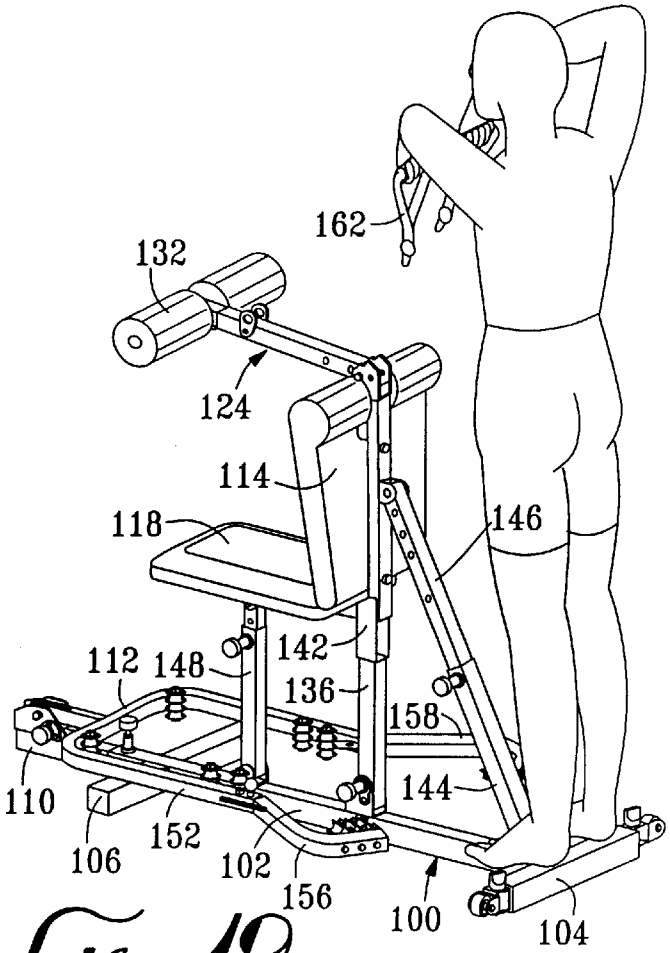
FIG. 49 is the device as positioned in FIG. 41 with the figure in a second position.
Figure 48:
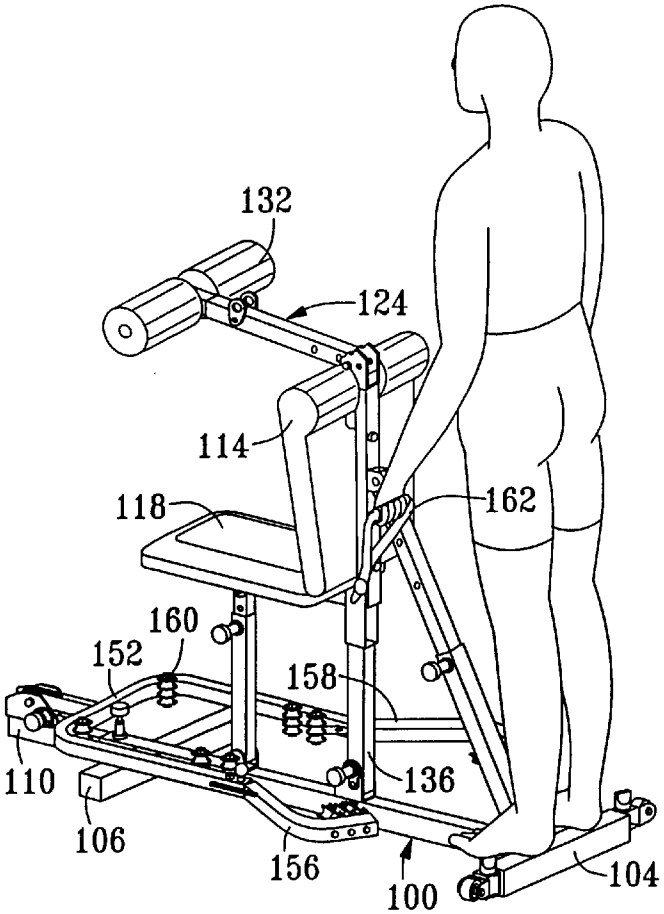
FIG. 48 is a perspective view of the exercise machine in the upright rows exercise position with a figure shown in a first position.
Figure 51:
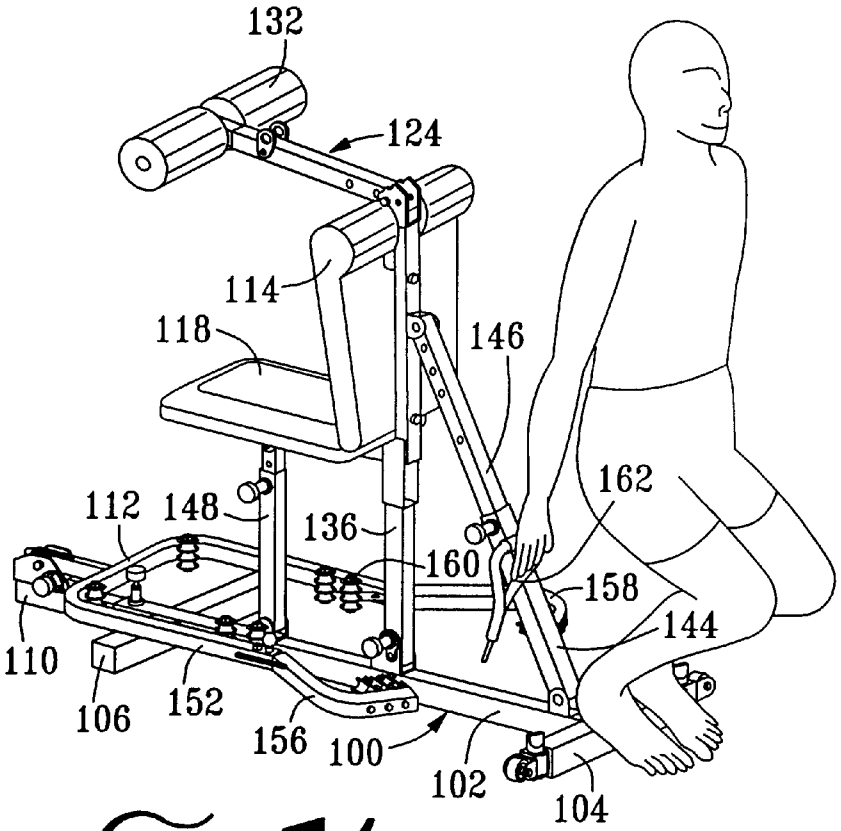
FIG. 51 is the device as positioned in FIG. 50 with the figure in a second position.
Figure 50:
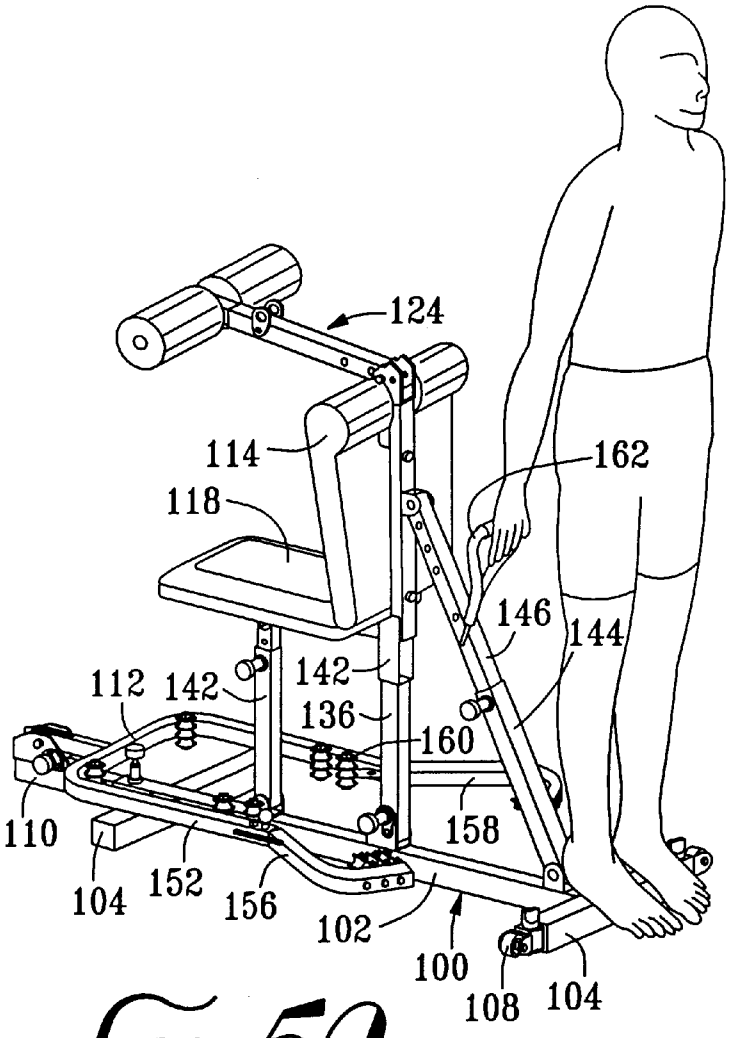
FIG. 50 is a perspective view of the exercise machine in the squat exercise position with a figure shown in a first position.

FIGS. 38–39 illustrate a lat pull down exercise position which is the same as the prior tricep extension exercise position but for the rotation of the arms 156 and 158 away from one another to an outward position which gives the appropriate spread for the exercise. The military press exercise position (FIGS. 40–41) and the bench press exercise position (FIGS. 42–43) vary from the prior position through the rotation of the arm support 152 downwardly to again lie against the support base 100. The arms 156 and 158 may be rotated to a comfortable position to provide the appropriate spread. The press position is then available for both the military press and the bench press exercises. To achieve the butterfly exercise position, the arms 156 and 158 are simply expended to their full lateral extension as illustrated in FIGS. 44–45.

Finally, the machine may be again tipped to have the support base 100 extending horizontally. If the seat has not been changed from the press position, it remains out of the way for use of a standing position at the front end of the support base 100. The leg 124 may be rotated fully out of the way as can be seen in FIGS. 46–51. By standing on the base element 104, the machine is insured to remain on the ground as various standing exercises may be performed. As shown in these Figures, a calf raise exercise, an upright row exercise and a squat exercise may be performed with the device in this orientation.

A most convenient cycle of exercises with the least number of adjustments is understood to be performed by progressing through the exercises in the order of the Figures as presented here. Thus, a versatile system providing for a large number of exercises and for a compact storage position is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An exercise machine comprising a support base;

a seat;

a seat back;

a leg;

arms;

one or more resistance elements attached to the arms;

articulated support linkage on the support base and in an operative position mounting the seat on the support base, mounting the seat back adjacent the seat, mounting the leg selectively pivotally at the seat with the seat being between the seat back and the leg, and mounting the arms on the support base with the seat back between the seat and the arms, the articulated support linkage including a storage position with the arms extending substantially along and adjacent to the support base, with the seat back and the seat being substantially coplanar and substantially parallel to the support base at a first distance therefrom, and with the leg extending from the seat to the support base.

2. The exercise machine of claim 1, the articulated support linkage further including a sit-up exercise position with the seat and the seat back being substantially coplanar at a second distance from the support base greater than the first distance, with the leg being fixed from rotating and with the support base extending horizontally.

3. The exercise machine of claim 2, the sit-up exercise position further being with the leg extending downwardly from the seat.

4. The exercise machine of claim 1, the leg including a first portion and a second portion, each portion being selectively pivotal at the seat, the second portion having pads extending laterally from the distal end thereof, the articulated support linkage further including a leg curl exercise position with the seat and the seat back being substantially coplanar at a second distance from the support base greater than the first distance, with the first leg portion being at substantially 90° from the second leg portion, with the second leg portion being pivotal from substantially coplanar with the seat, with one or more of the resistance elements being attached to the first leg portion and with the support base extending horizontally.

5. The exercise machine of claim 4, the leg curl exercise position further being with the arms extending substantially along the support base.

6. The exercise machine of claim 1, the articulated support linkage further including a leg extension exercise position with the seat back being at an obtuse included angle to the seat, with the seat at a second distance from the support base greater than the first distance, with the arms extending substantially along the support base, with the leg being pivotal from a first position extending 90° downwardly from the seat, with one or more of the resistance elements being attached to the leg and with the support base extending horizontally.

7. The exercise machine of claim 1 further comprising a hand grip, the articulated support linkage further including a bent over rows exercise position with the seat and seat back being substantially coplanar at a second distance from the support base greater than the first distance, with the arms extending substantially along the support base, with the hand grip attached to one or more of the resistance elements and with the support base extending horizontally.

8. The exercise machine of claim 1 further comprising two hand grips, the articulated support linkage further including a seated arm curl exercise position with the seat back being at an obtuse angle to the seat, with the seat being at a second distance from the support base greater than the first distance, with the arms extending substantially along the support base, with one or more of the resistance elements being attached to each hand grips, respectively, and with the support base extending horizontally.

9. The exercise machine of claim 1 further comprising two hand grips, the articulated support linkage further including a seated row exercise position with the seat and the seat back being substantially coplanar at a second distance from the support base greater than the first distance, with the arms extending outwardly from the plane of the seat back with the seat back between the arms and the seat, with one or more of the resistance elements being attached to each hand grip, respectively, and with the support base extending horizontally.

10. The exercise machine of claim 9, the support base including a base extension slidably extendable from the support base, the arms being mounted with the base extension, the seated row exercise position further being with the base extension extending from the support base.

11. The exercise machine of claim 1 further comprising two hand grips, the articulated support linkage further including a tricep extensions exercise position with the seat extending perpendicularly to the support base, with the leg being fixed and extending downwardly from the seat, with the arms extending outwardly parallel to the plane of the seat, with one or more of the resistance elements being attached to each hand grip, respectively, with the seat back at a second distance from the support base greater than the first distance, and with the support base extending vertically.

12. The exercise machine of claim 11, the support base including a base extension slidably extendable from the support base, the arms being mounted with the base extension, the tricep extensions exercise position further being with the base extension extending from the support base.

13. The exercise machine of claim 1 further comprising two hand grips and an arm support, the arm support being selectively pivotally mounted to the support base about an axis lying in the plane of the support base, the arms being selectively pivotally mounted to the arm support about axes lying in a plane normal to a plane containing the arm support pivotal mounting axis, the articulated support linkage further including a lat pull down exercise position with the seat extending perpendicularly to the support base, with the leg being fixed and extending downwardly from the seat, with the arm support and the arms extending outwardly parallel to the plane of the seat, with the seat back at a second distance from the support base greater than the first distance, with the arms pivoted to extend away from each other, with one or more of the resistance elements being attached to each hand grip, respectively, and with the support base extending vertically.

14. The exercise machine of claim 1 further comprising two hand grips, the articulated support linkage further including a press exercise position with the seat extending perpendicularly to the support base, with the seat back at a second distance from the support base greater than the first distance, with the leg being fixed and extending downwardly from the seat, with the arms extending substantially along the support base, with one or more of the resistance elements being attached to each hand grip, respectively, and with the support base extending vertically.

15. The exercise machine of claim 1 further comprising two hand grips and an arm support, the arm support being selectively pivotally mounted to the support base about an axis lying in the plane of the support base, the arms being selectively pivotally mounted to the arm support about axes lying in a plane normal to a plane containing the arm support pivotal mounting axis, the articulated support linkage further including a butterfly exercise position with the seat extending perpendicularly to the support base, with the leg being fixed and extending downwardly from the seat, with the seat back at a second distance from the support base greater than the first distance, with the arm support and the arms extending substantially along the support base, with the arms pivoted to extend away from each other, with one or more of the resistance elements being attached to each hand grip, respectively, and with the support base extending vertically.

* * * * *